US010989188B2

(12) United States Patent
Surjaatmadja et al.

(10) Patent No.: US 10,989,188 B2
(45) Date of Patent: Apr. 27, 2021

(54) OIL FIELD PUMPS WITH REDUCED MAINTENANCE

(71) Applicant: Halliburton Energy Services, Inc., Houston, TX (US)

(72) Inventors: Jim Basuki Surjaatmadja, Duncan, OK (US); Timothy H. Hunter, Duncan, OK (US); Robert Pipkin, Marlow, OK (US); Thomas M. Logan, Norman, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/522,860

(22) Filed: Jul. 26, 2019

(65) Prior Publication Data

US 2021/0025385 A1 Jan. 28, 2021

(51) Int. Cl.

| | |
|---|---|
| ***F16K 15/06*** | (2006.01) |
| ***F16K 15/18*** | (2006.01) |
| ***F04B 53/22*** | (2006.01) |
| ***F04B 7/04*** | (2006.01) |
| ***E21B 41/00*** | (2006.01) |
| *F04B 15/02* | (2006.01) |

(52) U.S. Cl.

CPC ..... *F04B 53/22* (2013.01); *E21B 41/00* (2013.01); *F04B 7/04* (2013.01); *F04B 15/02* (2013.01)

(58) Field of Classification Search

CPC ..... F16K 15/063; F16K 15/06; F16K 15/18

See application file for complete search history.

(56) References Cited

U.S. PATENT DOCUMENTS

| | | | | |
|---|---|---|---|---|
| 1,662,725 | A | 3/1928 | Toney, Jr. | |
| 1,675,082 | A * | 6/1928 | Aular | F16K 15/025 137/543.23 |
| 2,673,519 | A | 3/1954 | Halliburton | |
| 2,678,006 | A | 5/1954 | Gray | |
| 3,005,412 | A | 10/1961 | Camp | |

(Continued)

FOREIGN PATENT DOCUMENTS

| | | | |
|---|---|---|---|
| CH | 257522 | A | 10/1948 |
| DE | 19808724 | A1 | 9/1998 |

(Continued)

OTHER PUBLICATIONS

Filing Receipt and Specification for patent application entitled "Flexible Manifold for Reciprocating Pump," by Joseph A. Beisel, et al., filed Oct. 7, 2019 as U.S. Appl. No. 16/594,825.

(Continued)

*Primary Examiner* — Kenneth L Thompson

(74) *Attorney, Agent, or Firm* — Conley Rose, P.C.; Rodney B. Carroll

(57) ABSTRACT

A valve module comprising: a cylindrical canister containing a valve assembly for a high pressure pump, wherein the valve assembly comprises a valve body and a valve seat, wherein the valve module provides a fluid flow path from an inlet to an outlet of the valve module from one side of the valve seat along a central axis of the valve module to the other side of the valve seat along the central axis and between the valve body and the valve seat when the valve assembly is in an open configuration, and does not provide the fluid flow path when the valve assembly is in a closed configuration.

20 Claims, 9 Drawing Sheets

(56) References Cited

U.S. PATENT DOCUMENTS

| | | | | |
|---|---|---|---|---|
| 3,229,640 | A | 1/1966 | Williams | |
| 3,299,417 | A | 1/1967 | Sibthorpe | |
| 3,301,197 | A | 1/1967 | Dodson et al. | |
| 3,373,695 | A * | 3/1968 | Yohpe | F04B 53/1025 417/569 |
| 3,380,247 | A | 4/1968 | Colmerauer | |
| 3,427,988 | A * | 2/1969 | Schmieman | F04B 53/10 417/569 |
| 3,459,363 | A | 8/1969 | Miller | |
| 3,516,434 | A | 6/1970 | Noss | |
| 3,664,371 | A | 5/1972 | Schneider | |
| 3,887,305 | A | 6/1975 | Ito | |
| 4,341,235 | A | 7/1982 | Nord | |
| 4,478,561 | A | 10/1984 | Elliston | |
| 4,618,316 | A * | 10/1986 | Elliott | F04B 53/103 417/454 |
| 4,771,801 | A | 9/1988 | Crump et al. | |
| 4,784,588 | A | 11/1988 | Miyashita et al. | |
| 4,850,392 | A | 7/1989 | Crump et al. | |
| 4,939,923 | A | 7/1990 | Sharp | |
| 5,040,408 | A | 8/1991 | Webb | |
| 5,061,159 | A | 10/1991 | Pryor | |
| 5,072,622 | A | 12/1991 | Roach et al. | |
| 5,171,136 | A * | 12/1992 | Pacht | F04B 53/1025 137/454.4 |
| 5,176,025 | A | 1/1993 | Butts | |
| 5,195,876 | A * | 3/1993 | Hansen | F04B 53/007 417/307 |
| 5,226,445 | A | 7/1993 | Surjaatmadja | |
| 5,343,738 | A | 9/1994 | Skaggs | |
| 5,403,168 | A | 4/1995 | Evenson | |
| 5,720,325 | A | 2/1998 | Grantham | |
| 5,924,853 | A | 7/1999 | Pacht | |
| 6,029,691 | A * | 2/2000 | Tavor | F16K 1/12 137/219 |
| 6,032,699 | A | 3/2000 | Cochran et al. | |
| 6,082,392 | A | 7/2000 | Watkins, Jr. | |
| 6,164,188 | A | 12/2000 | Miser | |
| 6,342,272 | B1 | 1/2002 | Halliwell | |
| 6,513,556 | B1 * | 2/2003 | Nimberger | F16K 31/52433 137/522 |
| 6,607,010 | B1 | 8/2003 | Kashy | |
| 6,935,161 | B2 | 8/2005 | Hutchinson | |
| 7,798,165 | B2 | 9/2010 | McClung, Jr. | |
| 7,891,374 | B2 * | 2/2011 | Vicars | F16K 15/18 137/454.4 |
| 7,909,057 | B1 * | 3/2011 | Vicars | F16J 15/106 137/516.29 |
| 8,074,679 | B2 * | 12/2011 | Jensen | F04B 53/16 137/512 |
| 8,234,911 | B2 | 8/2012 | Jax | |
| 8,360,751 | B2 | 1/2013 | Duncan | |
| 8,366,408 | B2 | 2/2013 | Wago et al. | |
| 8,418,363 | B2 | 4/2013 | Patel | |
| 8,506,262 | B2 | 8/2013 | Leugemors et al. | |
| 8,550,102 | B2 | 10/2013 | Small | |
| 8,584,700 | B2 * | 11/2013 | Vicars | F16K 5/04 137/543.15 |
| 8,590,614 | B2 | 11/2013 | Surjaatmadja et al. | |
| 9,322,402 | B2 * | 4/2016 | Marette | F16J 1/12 |
| 9,499,895 | B2 | 11/2016 | Langan et al. | |
| 9,528,508 | B2 | 12/2016 | Thomeer et al. | |
| 9,617,654 | B2 | 4/2017 | Rajagopalan et al. | |
| 9,746,091 | B2 * | 8/2017 | Dwyer | F16K 15/063 |
| 9,822,894 | B2 | 11/2017 | Bayyouk et al. | |
| 10,221,847 | B2 * | 3/2019 | Dyer | F04B 39/12 |
| 10,760,567 | B2 * | 9/2020 | Salih | F04B 15/02 |
| 2007/0044848 | A1 | 3/2007 | Norman | |
| 2007/0267076 | A1 | 11/2007 | Strauss et al. | |
| 2008/0011057 | A1 | 1/2008 | Spaolonzi et al. | |
| 2009/0041588 | A1 | 2/2009 | Hunter et al. | |
| 2009/0041596 | A1 | 2/2009 | Ponomarev et al. | |
| 2009/0159133 | A1 | 6/2009 | Popke et al. | |
| 2009/0194174 | A1 | 8/2009 | Morgan et al. | |
| 2009/0246051 | A1 | 10/2009 | Kim | |
| 2009/0278069 | A1 | 11/2009 | Blanco et al. | |
| 2010/0038070 | A1 | 2/2010 | Blanco et al. | |
| 2010/0098568 | A1 | 4/2010 | Marica | |
| 2010/0126250 | A1 | 5/2010 | Jax | |
| 2011/0180740 | A1 | 7/2011 | Marica | |
| 2012/0148431 | A1 | 6/2012 | Gabriel | |
| 2012/0223267 | A1 | 9/2012 | Marica | |
| 2012/0279721 | A1 | 11/2012 | Surjaatmadja et al. | |
| 2012/0312402 | A1 | 12/2012 | Tyler | |
| 2013/0061942 | A1 | 3/2013 | Hulsey | |
| 2013/0319220 | A1 | 12/2013 | Lahuraka et al. | |
| 2014/0064996 | A1 | 3/2014 | Arima | |
| 2014/0127036 | A1 | 5/2014 | Buckley et al. | |
| 2014/0127058 | A1 | 5/2014 | Buckley et al. | |
| 2014/0127062 | A1 | 5/2014 | Buckley et al. | |
| 2014/0150889 | A1 | 6/2014 | Ragner | |
| 2014/0261790 | A1 | 9/2014 | Marica | |
| 2014/0312257 | A1 | 10/2014 | Marica | |
| 2014/0322050 | A1 | 10/2014 | Marette et al. | |
| 2014/0328701 | A1 | 11/2014 | Nathan | |
| 2014/0348677 | A1 | 11/2014 | Moeller et al. | |
| 2015/0132157 | A1 | 5/2015 | Whaley et al. | |
| 2016/0131131 | A1 | 5/2016 | Weaver et al. | |
| 2016/0131264 | A1 | 5/2016 | Bregazzi et al. | |
| 2016/0215588 | A1 | 7/2016 | Belshan et al. | |
| 2016/0281699 | A1 | 9/2016 | Gnessin et al. | |
| 2016/0319805 | A1 | 11/2016 | Dille | |
| 2018/0058431 | A1 | 3/2018 | Blume | |
| 2018/0058444 | A1 | 3/2018 | Blume | |
| 2018/0298894 | A1 | 10/2018 | Wagner et al. | |
| 2019/0120389 | A1 | 4/2019 | Foster et al. | |
| 2019/0145391 | A1 | 5/2019 | Davids | |
| 2019/0154035 | A1 | 5/2019 | Cordes et al. | |
| 2019/0226475 | A1 | 7/2019 | Stark et al. | |
| 2020/0347706 | A1 | 11/2020 | Nowell et al. | |

FOREIGN PATENT DOCUMENTS

| | | | |
|---|---|---|---|
| EP | 0580196 | A1 | 1/1994 |
| EP | 1103722 | A2 | 5/2001 |
| EP | 2383470 | A1 | 11/2011 |
| GB | 120622 | A | 11/1918 |
| GB | 450645 | A | 7/1936 |
| GB | 672173 | A | 5/1952 |
| GB | 1226014 | A | 3/1971 |
| GB | 1262826 | A | 2/1972 |
| JP | 63001012 | Y2 | 1/1988 |
| JP | 2002037217 | A | 2/2002 |
| JP | 2004257283 | A | 9/2004 |
| JP | 4121804 | B2 | 7/2008 |
| JP | 2009131747 | A | 6/2009 |
| JP | 5107651 | B2 | 12/2012 |
| JP | 2020040010 | A | 3/2020 |

OTHER PUBLICATIONS

Office Action (Restriction Requirement) dated Aug. 28, 2019, (7 pages), U.S. Appl. No. 16/522,874, filed Jul. 26, 2019.

Office Action (Restriction Requirement) dated Aug. 30, 2019, (5 pages), U.S. Appl. No. 16/436,356, filed Jun. 10, 2019.

Office Action dated Oct. 22, 2019 (27 pages), U.S. Appl. No. 16/522,874, filed Jul. 26, 2019.

Office Action dated Oct. 31, 2019 (21 pages), U.S. Appl. No. 16/436,356, filed Jun. 10, 2019.

Scully Intellicheck2, Complete Overfill Prevention and Retained Product Monitoring System, 67293 Rev B, Oct. 2013, 2 pages.

Scully Intellicheck2, Complete Overfill Prevention and Retained Product Monitoring System, 67293 Rev B, May 2014, 2 pages.

Scully Intellicheck3, Complete Overfill Prevention and Retained Product Monitoring System, XXXXX Rev A, Jun. 2016, 2 pages.

Filing receipt and specification for patent application entitled "Pump Fluid End with Easy Access Suction Valve," by Justin L. Hurst, et al., filed May 14, 2019 as U.S. Appl. No. 16/411,891.

Filing receipt and specification for patent application entitled "Easy Change Pump Plunger," by Justin L. Hurst, et al., filed May 14, 2019 as U.S. Appl. No. 16/411,894.

(56) References Cited

OTHER PUBLICATIONS

Filing receipt and specification for patent application entitled "Pump Valve Seat with Supplemental Retention," by Justin L. Hurst, et al., filed May 14, 2019 as U.S. Appl. No. 16/411,898.
Filing receipt and specification for patent application entitled "Flexible Manifold for Reciprocating Pump," by Joseph A. Beisel, et al., filed May 14, 2019 as U.S. Appl. No. 16/411,901.
Filing receipt and specification for patent application entitled "Valve Assembly for a Fluid End with Limited Access," by Justin L. Hurst, et al., filed May 14, 2019 as U.S. Appl. No. 16/411,910.
Filing receipt and specification for patent application entitled "Pump Plunger with Wrench Features," by Justin L. Hurst, at al., filed May 14, 2019 as U.S. Appl. No. 16/411,905.
Filing receipt and specification for patent application entitled "Pump Fluid End with Suction Valve Closure Assist," by Justin L. Hurst, et al., filed Jun. 10, 2019 as U.S. Appl. No. 16/436,312.
Filing receipt and specification for patent application entitled "Multi-Material Frac Valve Poppet," by Jim B. Surjaatmadja, et al., filed Jun. 10, 2019 as U.S. Appl. No. 16/436,356.
Filing receipt and specification for patent application entitled "Multi-Layer Coating for Plunger and/or Packing Sleeve," by Justin L. Hurst, et al., filed Jun. 10, 2019 as U.S. Appl. No. 16/436,389.
Acknowledgement receipt and specification for International application entitled "Multi-Layer Coating for Plunger and/or Packing Sleeve," by Justin L. Hurst, et al., filed Jun. 12, 2019 as International application No. PCT/US2019/036785.
Filing receipt and specification for patent application entitled "Pump Fluid End with Positional Indifference for Maintenance," by Justin L. Hurst, et al., filed May 14, 2019 as U.S. Appl. No. 16/411,911.
Acknowledgement receipt and specification for patent application entitled, "Fail Safe Suction Hose for Significantly Moving Suction Port," by Jim B. Surjaatmadja, et al., filed Jul. 26, 2019 as U.S. Appl. No. 16/522,874.
Acknowledgement receipt and specification for International application entitled "Oil Field Pumps with Reduced Maintenance," by Jim B. Surjaatmadja, et al., filed Jul. 30, 2019 as International application No. PCT/US2019/044191.
Acknowledgement receipt and specification for International application entitled "Fail Safe Suction Hose for Significantly Moving Suction Port," by Jim B. Surjaatmadja, et al., filed Jul. 30, 2019 as International application No. PCT/US2019/044194.
Foreign Communication from Related Application—International Search Report and Written Opinion of the International Searching Authority, International Application No. PCT/US2019/044191, dated Apr. 24, 2020, 13 pages.
Foreign Communication from Related Application—International Search Report and Written Opinion of the International Searching Authority, International Application No. PCT/US2020/022043, dated Jul. 3, 2020, 13 pages.
Kiani, Mahdi et al., "Numerical Modeling and Analytical Investigation of Autofrettage Process on the Fluid End Module of Fracture Pumps," Journal of Pressure Vessel Technology, Aug. 2018, pp. 0414031-0414037, vol. 140, ASME.
"Pump Catalog," Cat Pumps, Inc., 2014, 24 pages.
Furuta, Katsunori et al., "Study of the In-Line Pump System for Diesel Engines to Meet Future Emission Regulations," SAE International Congress and Exposition, Feb. 1998, pp. 125-136, Society of Automotive Engineers, Inc.
"550 Series: High Pressure, High Flow Water Jetting," Gardner Denver Water Jetting Systems, Inc., 2009, 4 pages.
Houghton, J.E. et al., "Improved Pump Run Time Using Snow Auto-Rotating Plunger (SARP) Pump," SPE Western Regional Meeting, May 1998, SPE46217, 6 pages, Society of Petroleum Engineers, Inc.
"Improved Double Acting Pump," Scientific American, 1867, pp. 248, vol. 17, No. 16, American Periodicals.
Langewis, Jr., C. et al., "Practical Hydraulics of Positive Displacement Pumps for High-Pressure Waterflood Installations," Journal of Petroleum Technology, Feb. 1971, pp. 173-179, SPE-AIME/Continental Oil Co.
Petzold, Martin et al., "Visualization and Analysis of the Multiphase Flow in an Electromagnetically Driven Dosing Pump," ASME/BATH Symposium on Fluid Power & Motion Control, Oct. 2013, FPMC2013-4433, 6 pages, ASME.
Romer, M. C. et al., "Field Trial of a Novel Self-Reciprocating Hydraulic Pump for Deliquification," SPE Production & Operations, 2017, 12 pages, Society of Petroleum Engineers.

* cited by examiner

OIL FIELD PUMPS WITH REDUCED MAINTENANCE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present disclosure relates generally to a method and apparatus for supplying pressurized fluids. More particularly, the present disclosure relates to methods and reciprocating devices for pumping fluids into a wellbore.

BACKGROUND

High-pressure pumps having reciprocating elements such as plungers or pistons are commonly employed in oil and gas production fields for operations such as drilling and well servicing. For instance, one or more reciprocating pumps may be employed to pump fluids into a wellbore in conjunction with activities including fracturing, acidizing, remediation, cementing, and other stimulation or servicing activities. Due to the harsh conditions associated with such activities, many considerations are generally taken into account when designing a pump for use in oil and gas operations. One design consideration may concern ease of access to pump fluid end components, as reciprocating pumps used in wellbore operations, for example, often encounter high cyclical pressures and various other conditions that can render pump components susceptible to wear and result in a need for servicing and maintenance of the pump.

Accordingly, it is desirable to provide a pump fluid end that facilitates replacement of components therein, such as a valve assembly, whereby maintenance can be simplified.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a reciprocating apparatus for pumping pressurized fluid. In embodiments, the reciprocating apparatus comprises a pump fluid end containing a valve module. The valve module of this disclosure comprises: a cylindrical canister containing a valve assembly, wherein the valve assembly comprises a valve body and a valve seat. The valve module provides a fluid flow path from an inlet to an outlet of the valve module along a central axis of the valve module and between the valve body and the valve seat when the valve assembly is in an open configuration, and does not provide the fluid flow path when the valve assembly is in a closed configuration. The valve body and the valve seat are coaxially aligned along the central axis. The valve body contacts the valve seat in the closed configuration and does not contact the valve seat in the open configuration. In embodiments, the reciprocating apparatus is a high-pressure pump configured to operate at a pressure greater than or equal to about 3,000 psi and/or in a well servicing operation and environment. Utilization of a modularized valve assembly (e.g., a modularized suction valve assembly and/or a modularized discharge valve assembly) as per this disclosure can enhance productive time of the reciprocating apparatus by reducing downtime for maintenance of a valve assembly.

Figure 1:
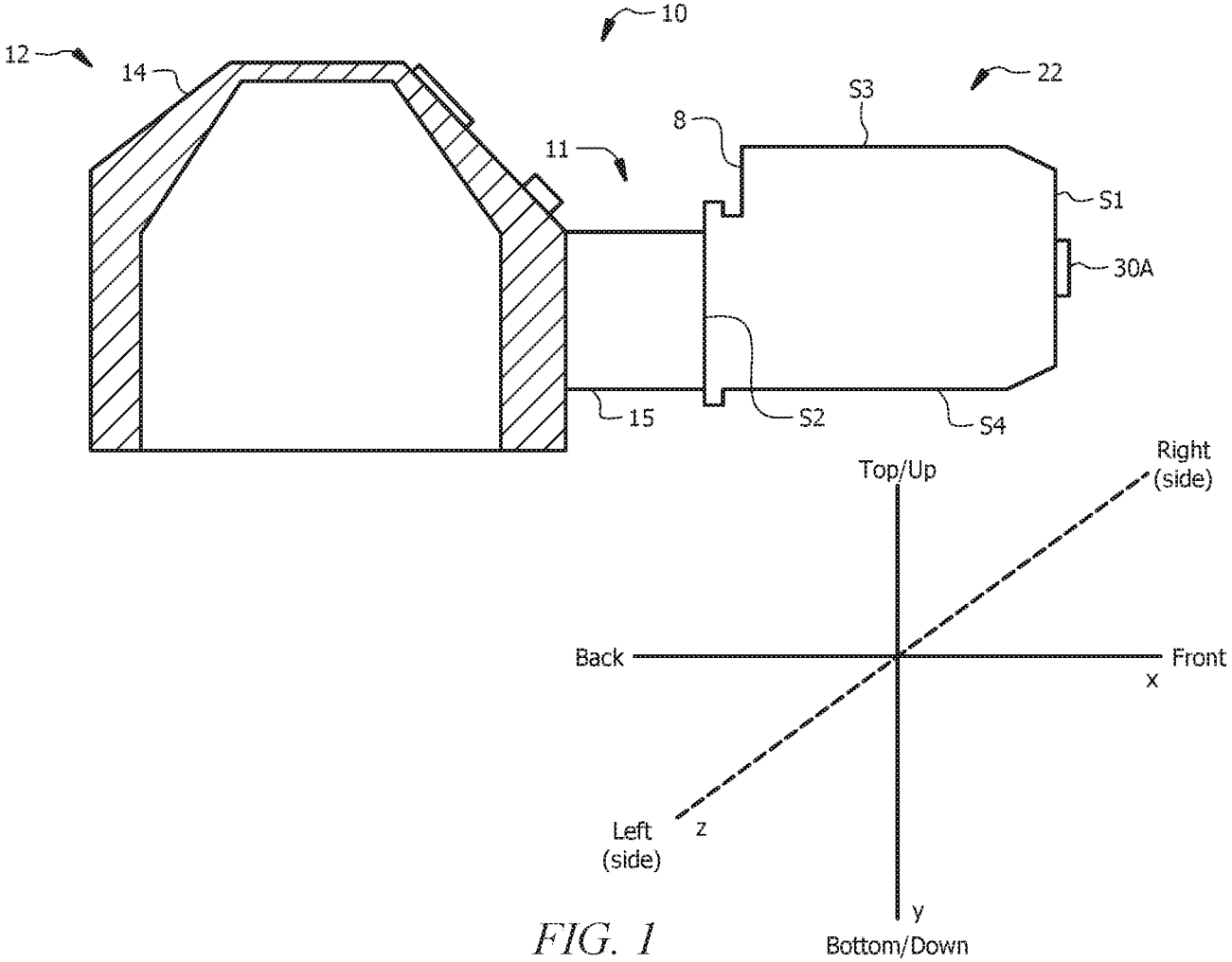
FIG. 1 is an elevational view of a reciprocating pump, according to embodiments of this disclosure.

A reciprocating apparatus of this disclosure may comprise any suitable pump operable to pump fluid. Non-limiting examples of suitable pumps include, but are not limited to, piston pumps, plunger pumps, and the like. In embodiments, the pump is a rotary- or reciprocating-type pump such as a positive displacement pump operable to displace pressurized fluid. The pump comprises a pump power end, a pump fluid end, and an integration section whereby a reciprocating element (e.g., a plunger) can be mechanically connected with the pump power end such that the reciprocating element can be reciprocated within a reciprocating element bore of the pump fluid end. FIG. 1 is an elevational view (e.g., side view) of a pump 10 (e.g., a reciprocating pump) according to an exemplary embodiment, the reciprocating pump comprising a pump power end 12, a pump fluid end 22, and an integration section 11. As illustrated in FIG. 1, pump fluid end has a front S1 opposite a back S2 along a first or x-axis, a top S3 opposite a bottom S4 along a second or y-axis, wherein the y-axis is in the same plane as and perpendicular to the x-axis, and a left side and a right side along a z-axis, wherein the z-axis is along a plane perpendicular to the plane of the x-axis and the y-axis. Accordingly, toward the top of pump fluid end 22 (and pump 10) is along the y-axis toward top S3, toward the bottom of pump fluid end 22 (and pump 10) is along the y-axis toward bottom S4, toward the front of pump fluid end 22 (and pump 10) is along the x-axis toward front S1, and toward the back of pump fluid end 22 (and pump 10) is along the x-axis away from front S1.

Figure 2A:
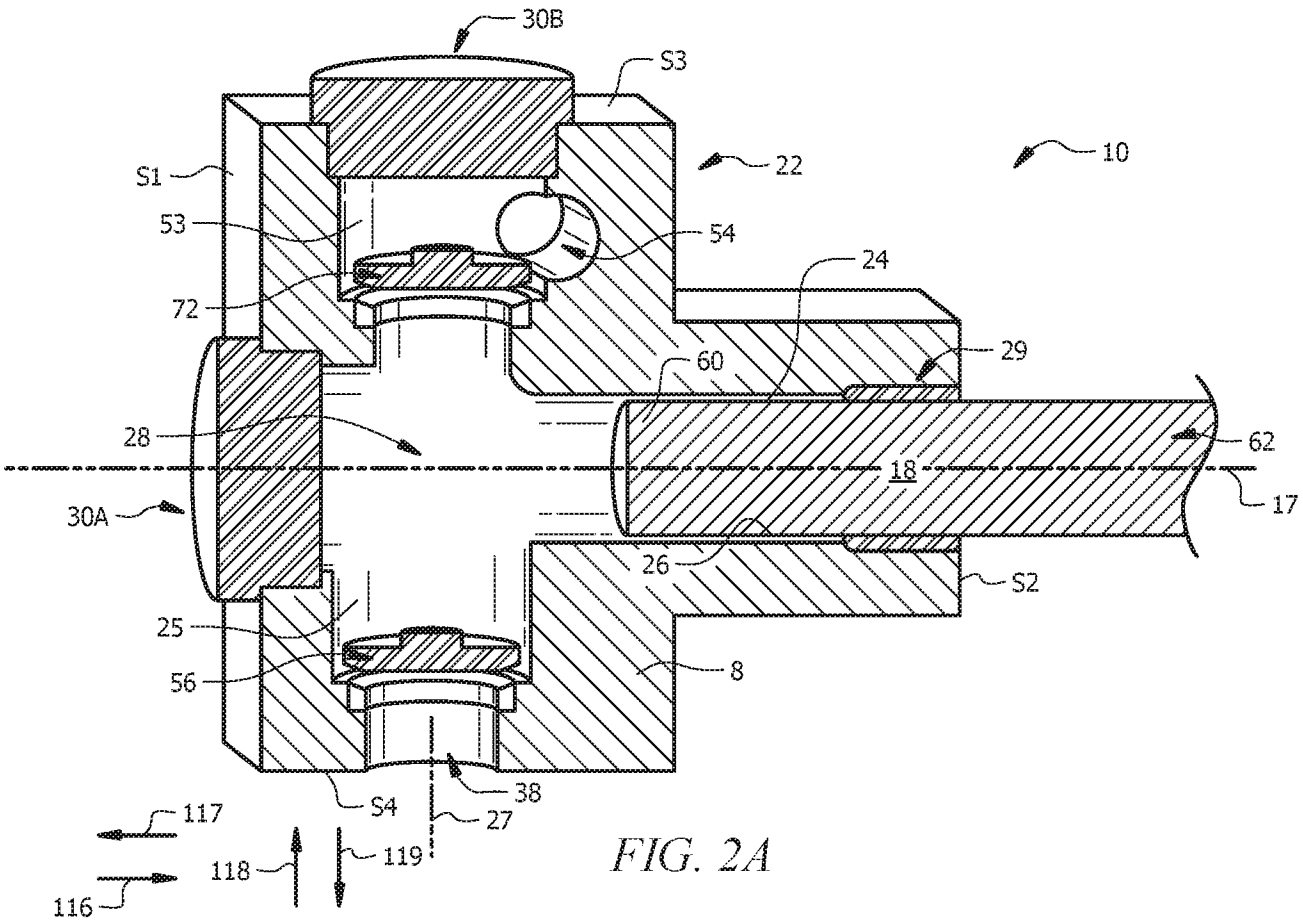
FIG. 2A is a cut-away illustration of an exemplary reciprocating pump comprising a cross-bore pump fluid end, according to embodiments of the present disclosure.
Figure 2B:
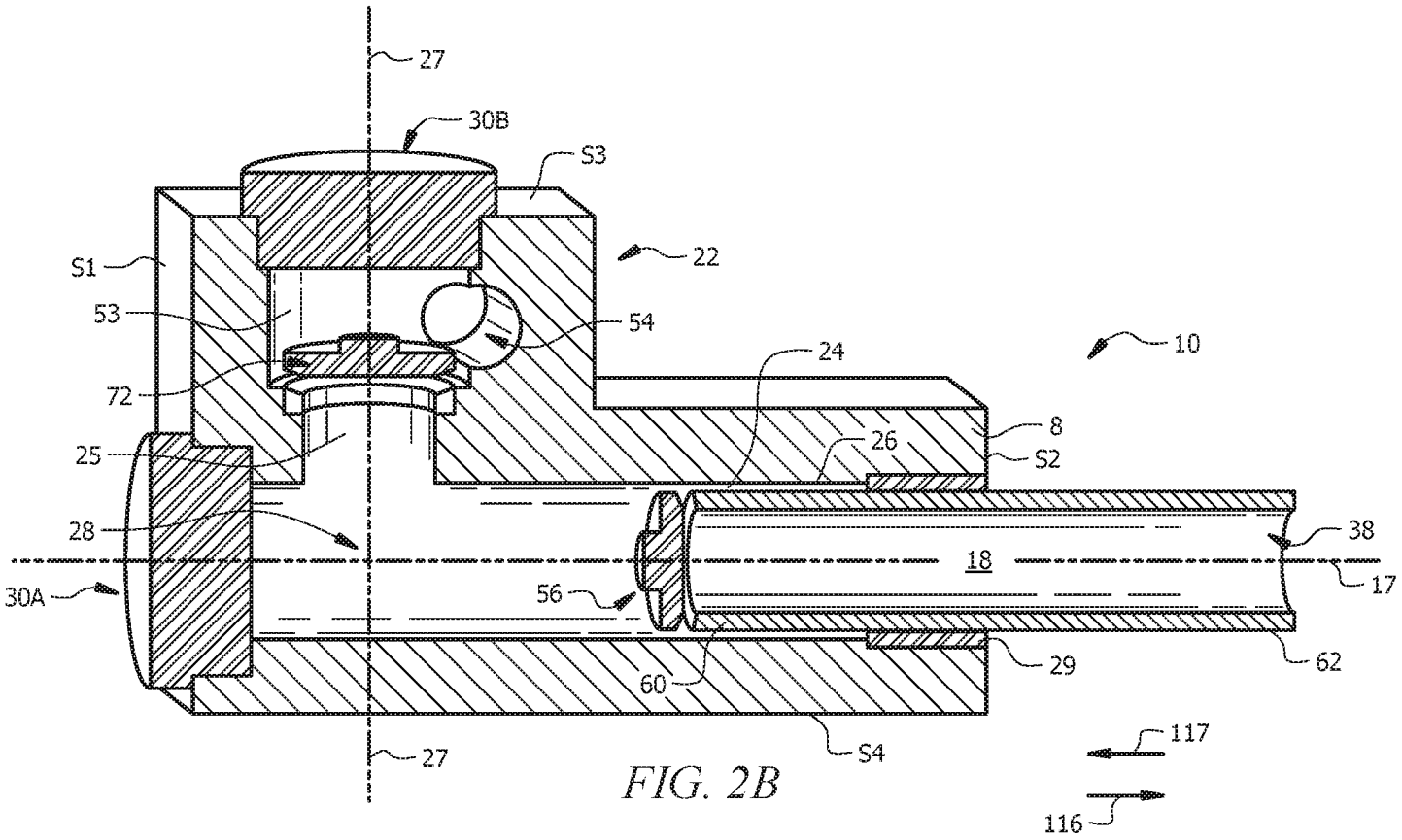
FIG. 2B is a cut-away illustration of an exemplary reciprocating pump comprising a cross-bore pump fluid end, according to other embodiments of the present disclosure.
Figure 3:
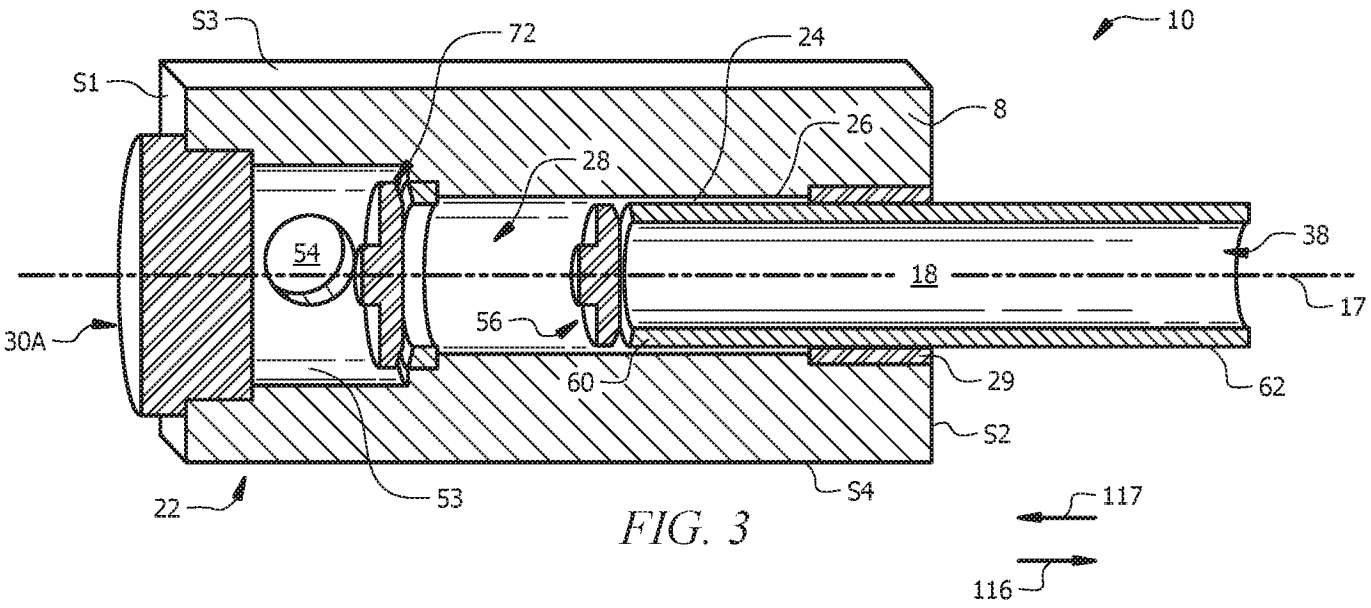
FIG. 3 is a cut-away illustration of an exemplary reciprocating pump comprising a concentric bore pump fluid end, according to embodiments of the present disclosure.

The pump fluid end 22 is integrated with the pump power end 12 via the integration section 11, such that pump power end 12 is operable to reciprocate the reciprocating element 18 within a reciprocating element bore 24 (FIGS. 2-3) of the pump fluid end 22. The reciprocating element bore 24 is at least partially defined by a cylinder wall 26. As described further hereinbelow with reference to FIGS. 2A-2B and FIG. 3, pump fluid end 22 can be a multi-bore pump fluid end (also referred to herein as a cross-bore pump fluid end) 22 or, alternatively, an in-line or "concentric" bore pump fluid end. As utilized herein, multi-bore pump fluid ends can comprise "T-bore" pump fluid ends, "X-bore" (e.g., cross shaped bore) pump fluid ends, or "Y-bore" pump fluid ends. FIG. 2A is a schematic showing a cross-bore pump fluid end 22 engaged with a reciprocating element 18, wherein the cross-bore pump fluid end 22 comprises a cross-bore 25 that makes a cross shape (+) relative to reciprocating element bore 24. FIG. 2B is a schematic showing a cross-bore pump fluid end 22 engaged with a reciprocating element 18, wherein the cross bore pump fluid end 22 comprises a tee-bore 25 that makes a "T" shape relative to reciprocating element bore 24. FIG. 3 is a schematic showing a concentric bore pump fluid end 22 engaged with a reciprocating element 18. As discussed further below, the pump 10 includes at least one fluid inlet 38 for receiving fluid from a fluid source, e.g., a suction line, suction header, storage or mix tank, blender, discharge from a boost pump such as a centrifugal pump, etc. The pump 10 also includes at least one discharge outlet 54 for discharging fluid to a discharge source, e.g., a flowmeter, pressure monitoring and control system, distribution header, discharge line, wellhead, discharge manifold pipe, and the like.

The pump 10 may comprise any suitable pump power end 12 for enabling the pump 10 to perform pumping operations (e.g., pumping a wellbore servicing fluid downhole). Similarly, the pump 10 may include any suitable housing 14 for containing and/or supporting the pump power end 12 and components thereof. The housing 14 may comprise various combinations of inlets, outlets, channels, and the like for circulating and/or transferring fluid. Additionally, the housing 14 may include connections to other components and/or systems, such as, but not limited to, pipes, tanks, drive mechanisms, etc. Furthermore, the housing 14 may be configured with cover plates or entryways for permitting access to the pump power end 12 and/or other pump components. As such, the pump 10 may be inspected to determine whether parts need to be repaired or replaced. The pump power end may also be hydraulically driven, whether it is a non-intensifying or an intensifying system.

Figure 4:
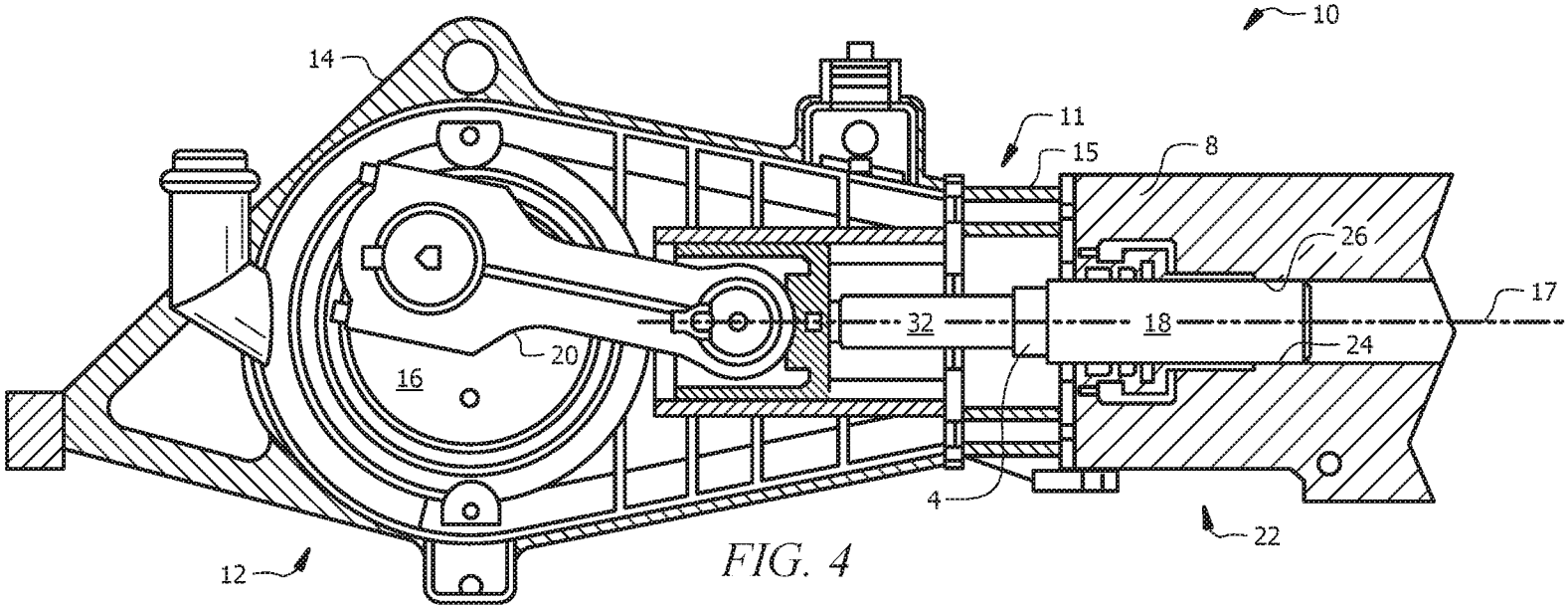
FIG. 4 is cut-away illustration of a pump power end of a pump, according to embodiments of the present disclosure.

Those versed in the art will understand that the pump power end 12 may include various components commonly employed in pumps. Pump power end 12 can be any suitable pump known in the art and with the help of this disclosure to be operable to reciprocate reciprocating element 18 in reciprocating element bore 24. For example, without limitation, pump power end 12 can be operable via and comprise a crank and slider mechanism, a powered hydraulic/pneumatic/steam cylinder mechanism or various electric, mechanical or electro-mechanical drives. FIG. 4 provides a cutaway illustration of an exemplary pump 10 of this disclosure, showing an exemplary pump power end 12, integrated via integration section 11 with a pump fluid end 22, wherein the pump power end 12 is operable to reciprocate the reciprocating element 18 within a reciprocating element bore 24 of the pump fluid end 22. Briefly, for example, the pump power end 12 may include a rotatable crankshaft 16 attached to at least one reciprocating element 18 (e.g., a plunger or piston) by way of a crank arm/connecting rod 20. Additionally, an engine (e.g., a diesel engine), motor, or other suitable power source may be operatively connected to the crankshaft 16 (e.g., through a transmission and drive shaft) and operable to actuate rotation thereof. In operation, rotation of the crankshaft 16 induces translational movement of the crank arm/connecting rod 20, thereby causing the reciprocating element 18 to extend and retract along a flow path, which may generally be defined by a central axis 17 within a reciprocating element bore 24 (sometimes referred to herein for brevity as a "reciprocating element bore 24" or simply a "bore 24", and not wishing to be limited to a particular reciprocating element 18). Pump 10 of FIG. 1 is typically mounted on a movable structure such as a semi-tractor trailer or skid, and the moveable structure may contain additional components, such as a motor or engine (e.g., a diesel engine), that provides power (e.g., mechanical motion) to the pump power end 12 (e.g., a crankcase comprising crankshaft 16 and related connecting rods 20).

Of course, numerous other components associated with the pump power end 12 of the pump 10 may be similarly employed, and therefore, fall within the purview of the present disclosure. Furthermore, since the construction and operation of components associated with pumps of the sort depicted in FIG. 1 are well known and understood, discussion of the pump 10 will herein be limited to the extent necessary for enabling a proper understanding of the disclosed embodiments.

As noted hereinabove, the pump 10 comprises a pump fluid end 22 attached to the pump power end 12. Various embodiments of the pump fluid end 22 are described in detail below in connection with other drawings, for example FIGS. 2A-2B and FIG. 3. Generally, the pump fluid end 22 comprises at least one fluid inlet 38 for receiving fluid, and at least one discharge outlet 54 through which fluid flows out of the discharge chamber 53. The pump fluid end 22 also comprises at least one valve assembly for controlling the receipt and output of fluid. For example, the pump fluid end 22 can comprise a suction valve assembly 56 and a discharge valve assembly 72. According to this disclosure, at least one of the suction valve assembly 56 and the discharge valve assembly 72 is provided by a valve module, as described hereinbelow with reference to FIG. 5A, FIG. 5B, and FIG. 6. The pump fluid end 22 may include any suitable component(s) and/or structure(s) for containing and/or supporting the reciprocating element 18 and providing a cylinder wall 26 at least partially defining a reciprocating element bore 24 along which the pump power end can reciprocate the reciprocating element during operation of the pump.

In embodiments, the pump fluid end 22 may comprise a cylinder wall 26 at least partially defining a bore 24 through which the reciprocating element 18 may extend and retract. Additionally, the bore 24 may be in fluid communication with a discharge chamber 53 formed within the pump fluid end 22. Such a discharge chamber 53, for example, may be configured as a pressurized discharge chamber 53 having a discharge outlet 54 through which fluid is discharged by the reciprocating element 18. Thus, the reciprocating element 18 may be movably disposed within the reciprocating element bore 24, which may provide a fluid flow path into and/or out of the pump chamber. During operation of the pump 10, the reciprocating element 18 may be configured to reciprocate along a path (e.g., along central axis 17 within bore 24 and/or pump chamber 28, which corresponds to reciprocal movement parallel to the x-axis of FIG. 1) to transfer a supply of fluid to the pump chamber 28 and/or discharge fluid from the pump chamber 28.

In operation, the reciprocating element 18 extends and retracts along a flow path to alternate between providing forward strokes (also referred to as discharge strokes and correlating to movement in a positive direction parallel to the x-axis of FIG. 1, indicated by arrow 117) and return strokes (also referred to as suction strokes and correlating to movement in a negative direction parallel to the x-axis of FIG. 1, indicated by arrow 116), respectively. During a forward stroke, the reciprocating element 18 extends away from the pump power end 12 and toward the pump fluid end 22. Before the forward stoke begins, the reciprocating element 18 is in a fully retracted position (also referred to as bottom dead center (BDC) with reference to the crankshaft 16), in which case the suction valve assembly 56 can be in a closed configuration having allowed fluid to flow into the (e.g., high pressure) pump chamber 28. (As utilized here, "high pressure" indicates possible subjection to high pressure during discharge.) When discharge valve assembly 72 is in a closed configuration (e.g., under the influence of a closing mechanism, such as a spring), the high pressure in a discharge pipe or manifold containing discharge outlet 54 prevents fluid flow into discharge chamber 53 and causes pressure in the pump chamber 28 to accumulate upon stroking of the reciprocating element 18. When the reciprocating element 18 begins the forward stroke, the pressure builds inside the pump chamber 28 and acts as an opening force that results in positioning of the discharge valve assembly 72 in an open configuration, while a closing force (e.g., via a closing mechanism, such as a spring and/or pressure increase inside pump chamber 28) urges the suction valve assembly 56 into a closed configuration. When utilized in connection with a valve assembly, 'open' and 'closed' refer, respectively, to a configuration in which fluid can flow through the valve assembly (e.g., can pass between a valve body (e.g., a movable poppet) and a valve seat thereof) and a configuration in which fluid cannot flow through the valve assembly (e.g., cannot pass between a valve body (e.g., a movable poppet) and a valve seat thereof). As the reciprocating element 18 extends forward, fluid within the pump chamber 28 is discharged through the discharge outlet 54.

During a return stroke, the reciprocating element 18 reciprocates or retracts away from the pump fluid end 22 and towards the pump power end 12 of the pump 10. Before the return stroke begins, the reciprocating element 18 is in a fully extended position (also referred to as top dead center (TDC) with reference to the crankshaft 16), in which case the discharge valve assembly 72 can be in a closed configuration having allowed fluid to flow out of the pump chamber 28 and the suction valve assembly 56 is in a closed configuration. When the reciprocating element 18 begins and retracts towards the pump power end 12, the discharge valve assembly 72 assumes a closed configuration, while the suction valve assembly 56 opens. As the reciprocating element 18 moves away from the discharge valve 72 during a return stroke, fluid flows through the suction valve assembly 56 and into the pump chamber 28.

With reference to the embodiments of FIG. 2A, which is a schematic showing a cross-bore pump fluid end 22 engaged with a reciprocating element 18, cross-bore pump fluid end 22 comprises a cross-bore fluid end body 8, a cross-bore pump chamber 28, a suction valve assembly 56, and a discharge valve assembly 72. In this cross-bore configuration, suction valve assembly 56 and discharge valve assembly 72 are located in a bore or channel 25 (also referred to herein as a cross bore 25) of pump chamber 28, wherein bore 25 has a central axis 27 that is parallel to the y-axis of FIG. 1 and is perpendicular to bore 24 in which reciprocating element 18 reciprocates during operation. Suction valve assembly 56 and discharge valve assembly 72 are operable to direct fluid flow within the pump 10. When reciprocating element 18 retracts, or moves along central axis 17 in a direction away from the pump chamber 28 and the pump fluid end 22 and toward the pump power end 12 (as indicated by arrow 116), a suction valve of the suction valve assembly 56 opens (e.g., either under natural flow or other biasing means), and a discharge valve of discharge valve assembly 72 will be closed, whereby fluid enters pump chamber 28 via fluid inlet 38. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge outlet 54.

With reference to the embodiment of FIG. 2B, which is a schematic showing a T-bore pump fluid end 22 engaged with a reciprocating element 18, T-bore pump fluid end 22 comprises a T-bore fluid end body 8, a T-shaped pump chamber 28, a suction valve assembly 56, and a discharge valve assembly 72. In this T-bore configuration of FIG. 2B, suction valve assembly 56 is coupled with front end 60 of reciprocating element 18 and discharge valve assembly 72 is positioned in bore 25 that makes a tee with reciprocating element bore 24, i.e., central axis 17 of reciprocating element bore 24 is also the central axis of suction pump assembly 56 and perpendicular to a central axis 27 of discharge valve assembly 72 (i.e., central axis 27 is parallel to the y-axis of FIG. 1 and is perpendicular to bore 24 in which reciprocating element 18 reciprocates during operation). Suction valve assembly 56 and discharge valve assembly 72 are operable to direct fluid flow within the pump 10. When reciprocating element 18 retracts, or moves along central axis 17 in a direction away from the pump chamber 28 and the pump fluid end 22 and toward the pump power end 12 (as indicated by arrow 116), a suction valve of the suction valve assembly 56 opens (e.g., either under natural flow or other biasing means), and a discharge valve of discharge valve assembly 72 will be closed, whereby fluid enters pump chamber 28 via fluid inlet 38. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge outlet 54.

With reference to the embodiment of FIG. 3, which is a schematic showing a concentric pump fluid end 22 engaged with a reciprocating element 18, concentric bore pump fluid end 22 comprises a concentric bore fluid end body 8, a concentric pump chamber 28, a suction valve assembly 56, and a discharge valve assembly 72. In this concentric bore configuration, suction valve assembly 56 and discharge valve assembly 72 are positioned in-line (also referred to as coaxial) with reciprocating element bore 24, i.e., central axis 17 of reciprocating element bore 24 is also the central axis of suction pump assembly 56 and discharge valve assembly 72). Suction valve assembly 56 and discharge valve assembly 72 are operable to direct fluid flow within the pump 10. In some concentric bore fluid end designs, fluid flows within a hollow reciprocating element (e.g., a hollow plunger) 18. In some such embodiments, the reciprocating element bore 24 of such a concentric bore fluid end design can be defined by a high pressure cylinder 26 providing a high pressure chamber and a low pressure cylinder (not depicted in the embodiment of FIG. 3) providing a low pressure chamber toward tail end 62 of reciprocating element 18, whereby fluid from fluid inlet 38 enters reciprocating element 18. When reciprocating element 18 retracts, or moves along central axis 17 in a direction away from the pump chamber 28 and pump fluid end 22 and toward pump power end 12 (as indicated by arrow 116), a suction valve of the suction valve assembly 56 opens (e.g., either under natural flow and/or other biasing means), and a discharge valve of discharge valve assembly 72 will be closed, whereby fluid enters pump chamber 28 via a fluid inlet 38. For a concentric bore pump fluid end 22 design, the fluid inlet can be configured to introduce fluid into pump chamber 28 via a reciprocating element 18 that is hollow and/or via a low pressure chamber as described above. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge chamber 53 and discharge outlet 54.

A pump 10 of this disclosure can comprise one or more access ports. For example, with reference to the cross-bore fluid end body 8 embodiments of FIG. 2A and FIG. 2B, a front access port 30A can be located on a front S1 of the pump fluid end 22 opposite a back S2 of the pump fluid end 22, wherein the back S2 of the pump fluid end is proximal the pump power end 12, upon integration therewith via integration section 11. A top access port 30B can be located on a top S3 of the pump fluid end 22 opposite a bottom S4 of the pump fluid end 22, wherein the top S1 of the pump fluid end 22 is above central axis 17 and the bottom S4 of the pump fluid end 22 is below central axis 17. With reference to the concentric fluid end body 8 embodiment of FIG. 3, a front access port 30A can be located on a front S1 of the pump fluid end 22 opposite a back S2 of the pump fluid end 22, wherein the back S2 of the pump fluid end is proximal the pump power end 12, upon integration therewith via integration section 11. Locations described as front S1, back S2, top S3, and bottom S4 are further described with reference to the x-y-z coordinate system shown in FIG. 1 and further can be relative to a surface (e.g., a trailer bed, the ground, a platform, etc.) upon which the pump 10 is located, a bottom S4 of the pump fluid end being proximal the surface (e.g., trailer bed) upon which the pump 10 is located. Generally, due to size and positioning of pump 10, the front S1 and top S3 of the pump fluid end 22 are more easily accessible than a back S2 or bottom S4 thereof. In a similar manner, a front of pump 10 is distal the pump power end 12 and a back of the pump 10 is distal the pump fluid end 22. The integration section 11 can be positioned in a space between the pump fluid end 22 and the pump power end 12, and can be safeguarded (e.g., from personnel) via a cover 15.

In embodiments, a pump fluid end 22 and pump 10 of this disclosure comprise at least one access port located on a side of the discharge valve assembly 72 opposite the suction valve assembly 56. For example, in the cross-bore pump fluid end 22 embodiment of FIG. 2A, top access port 30B is located on a side (e.g., top side) of discharge valve assembly 72 opposite suction valve assembly 56, while in the concentric bore pump fluid end 22 embodiment of FIG. 3, front access port 30A is located on a side (e.g., front side) of discharge valve assembly 72 opposite suction valve assembly 56.

In embodiments, one or more seals 29 (e.g., "o-ring" seals, packing seals, or the like), also referred to herein as 'primary' reciprocating element packing 29 (or "packing 29") may be arranged around the reciprocating element 18 to provide sealing between the outer walls of the reciprocating element 18 and the inner walls 26 defining at least a portion of the reciprocating element bore 24. The inner walls 26 may be provided by fluid end body 8 or a sleeve within reciprocating element bore 24, as described below. In some concentric bore fluid end designs, a second set of seals (also referred to herein as 'secondary' reciprocating element packing; not shown in the Figures) may be fixedly arranged around the reciprocating element 18 to provide sealing between the outer walls of the reciprocating element 18 and the inner walls of a low-pressure cylinder that defines the low pressure chamber described hereinabove (e.g., wherein the secondary packing is farther back along the x-axis and delineates a back end of the low pressure chamber that extends from the primary packing 29 to the secondary packing). In embodiments, only a primary reciprocating element packing is utilized, as fluid enters tail end 62 of reciprocating element 18 without first contacting an outer peripheral wall thereof (i.e., no secondary reciprocating element packing is needed/utilized, because no low pressure chamber external to reciprocating element 18 is utilized). Skilled artisans will recognize that the seals may comprise any suitable type of seals, and the selection of seals may depend on various factors e.g., fluid, temperature, pressure, etc.

While the foregoing discussion focused on a pump fluid end 22 comprising a single reciprocating element 18 disposed in a single reciprocating element bore 24, it is to be understood that the pump fluid end 22 may include any suitable number of reciprocating elements. As discussed further below, for example, the pump 10 may comprise a plurality of reciprocating elements 18 and associated reciprocating element bores 24 arranged in parallel and spaced apart along the z-axis of FIG. 1 (or another arrangement such as a V block or radial arrangement). In such a multi-bore pump, each reciprocating element bore may be associated with a respective reciprocating element and crank arm, and a single common crankshaft may drive each of the plurality of reciprocating elements and crank arms. Alternatively, a multi-bore pump may include multiple crankshafts, such that each crankshaft may drive a corresponding reciprocating element. Furthermore, the pump 10 may be implemented as any suitable type of multi-bore pump. In a non-limiting example, the pump 10 may comprise a Triplex pump having three reciprocating elements 18 (e.g., plungers or pistons) and associated reciprocating element bores 24, discharge valve assemblies 72 and suction valve assemblies 56, or a Quintuplex pump having five reciprocating elements 18 and five associated reciprocating element bores 24, discharge valve assemblies 72 and suction valve assemblies 56.

Reciprocating element bore 24 can have an inner diameter slightly greater than the outer diameter of the reciprocating element 18, such that the reciprocating element 18 may sufficiently reciprocate within reciprocating element bore 24 (optionally, within a sleeve, as described hereinbelow). In embodiments, the fluid end body 8 of pump fluid end 22 has a pressure rating ranging from about 100 psi to about 3000 psi, or from about 2000 psi to about 10,000 psi, from about 5000 psi to about 30,000 psi, or from about 3000 psi to about 50,000 psi or greater. The fluid end body 8 of pump fluid end 22 may be cast, forged, machined, printed or formed from any suitable materials, e.g., steel, metal alloys, or the like. Those versed in the art will recognize that the type and condition of material(s) suitable for the fluid end body 8 may be selected based on various factors. In a wellbore servicing operation, for example, the selection of a material may depend on flow rates, pressure rates, wellbore service fluid types (e.g., particulate type and/or concentration present in particle laden fluids such as fracturing fluids or drilling fluids, or fluids comprising cryogenic/foams), etc. Moreover, the fluid end body 8 (e.g., cylinder wall 26 defining at least a portion of reciprocating element bore 24 and/or pump chamber 28) may include protective coatings for preventing and/or resisting abrasion, erosion, and/or corrosion.

In embodiments, the cylindrical shape (e.g., providing cylindrical wall(s) 26) of the fluid end body 8 may be pre-stressed in an initial compression. Moreover, a high-pressure cylinder(s) providing the cylindrical shape (e.g., providing cylindrical wall(s) 26) may comprise one or more sleeves (e.g., heat-shrinkable sleeves). Additionally or alternatively, the high-pressure cylinder(s) may comprise one or more composite overwraps and/or concentric sleeves ("over-sleeves"), such that an outer wrap/sleeve pre-loads an inner wrap/sleeve. The overwraps and/or over-sleeves may be non-metallic (e.g., fiber windings) and/or constructed from relatively lightweight materials. Overwraps and/or over-sleeves may be added to increase fatigue strength and overall reinforcement of the components.

The cylinders and cylindrical-shaped components (e.g., providing cylindrical wall 26) associated with the pump fluid end body 8 of pump fluid end 22 may be held in place within the pump 10 using any appropriate technique. For example, components may be assembled and connected, e.g., bolted, welded, etc. Additionally or alternatively, cylinders may be press-fit (e.g., interference fit) into openings machined or cast into the pump fluid end 22 or other suitable portion of the pump 10. Such openings may be configured to accept and rigidly hold cylinders (e.g., having cylinder wall(s) 26 at least partially defining reciprocating element bore 24) in place so as to facilitate interaction of the reciprocating element 18 and other components associated with the pump 10.

In embodiments, the reciprocating element 18 comprises a plunger or a piston. While the reciprocating element 18 may be described herein with respect to embodiments comprising a plunger, it is to be understood that the reciprocating element 18 may comprise any suitable component for displacing fluid. In a non-limiting example, the reciprocating element 18 may be a piston. As those versed in the art will readily appreciate, a piston-type pump generally employs sealing elements (e.g., rings, packing, etc.) attached to the piston and movable therewith. In contrast, a plunger-type pump generally employs fixed or static seals (e.g., primary seal or packing 29) through which the plunger moves during each stroke (e.g., suction stroke or discharge stroke).

As skilled artisans will understand, the reciprocating element 18 may include any suitable size and/or shape for extending and retracting along a flow path within the pump fluid end 22. For instance, reciprocating element 18 may comprise a generally cylindrical shape, and may be sized such that the reciprocating element 18 can sufficiently slide against or otherwise interact with the inner cylinder wall 26. In embodiments, one or more additional components or mechanical linkages 4 (FIG. 4; e.g., clamps, adapters, extensions, etc.) may be used to couple the reciprocating element 18 to the pump power end 12 (e.g., to a pushrod 30).

In some embodiments (e.g., cross-bore pump fluid end 22 embodiments such as FIG. 2A), the reciprocating element may be substantially solid and/or impermeable (e.g., not hollow). In alternative embodiments (e.g., tee-bore pump fluid end 22 embodiment such as FIG. 2B and concentric bore pump fluid end 22 embodiment such as FIG. 3), the reciprocating element 18 comprises a peripheral wall defining a hollow body. Additionally (e.g., tee-bore pump fluid end 22 embodiments such as FIG. 2B and concentric bore pump fluid end 22 embodiments such as FIG. 3), a portion of the peripheral wall of reciprocating element 18 may be generally permeable or may include an input through which fluid may enter the hollow body and an output through which fluid may exit the hollow body. Furthermore, while the reciprocating element 18 may, in embodiments, define a substantially hollow interior and include a ported body, a base of the reciprocating element 18 proximal the pump power end 12, when assembled, may be substantially solid and/or impermeable (e.g., a plunger having both a hollow portion and a solid portion).

The reciprocating element 18 comprises a front or free end 60. In embodiments comprising concentric bore pump fluid end designs 22 such as shown in FIG. 3, the reciprocating element 18 can contain or at least partially contain the suction valve assembly 56. In one aspect, the suction valve assembly 56 is at least partially disposed within the reciprocating element 18 at or proximate to the front end 60 thereof. At an opposite or tail end 62 (also referred to as back end 62) of the reciprocating element 18, the reciprocating element 18 may include a base coupled to the pump power end 12 of the pump 10 (e.g., via crank arm 20). In embodiments, the tail end 62 of the reciprocating element 18 is coupled to the pump power end 12 outside of pump fluid end 22, e.g., within integration section 11.

As noted above, pump fluid end 22 contains a suction valve assembly 56. Suction valve assembly 56 may alternately open or close to permit or prevent fluid flow. Skilled artisans will understand that the suction valve assembly 56 may be of any suitable type or configuration (e.g., gravity- or spring-biased, flow activated, etc.). Those versed in the art will understand that the suction valve assembly 56 may be disposed within the pump fluid end 22 at any suitable location therein. For instance, the suction valve assembly 56 may be disposed within the bore 25 below central axis 17 of the pump fluid end 22, in cross-bore pump fluid end 22 designs such as FIG. 2A, such that a suction valve body (e.g., a poppet assembly) of the suction valve assembly 56 moves away from a suction valve seat within the a suction valve seat housing of reciprocating element 18 when the suction valve assembly 56 is in an open configuration and toward the suction valve seat when the suction valve assembly 56 is in a closed configuration. The suction valve assembly 56 may be disposed within reciprocating element bore 24 and at least partially within reciprocating element 18 in tee-bore pump fluid end 22 designs such as FIG. 2B and concentric bore pump fluid end 22 designs such as FIG. 3, such that a suction valve body (e.g., a poppet assembly) of the suction valve assembly 56 moves away from a suction valve seat within and/or coupled with a suction valve seat housing of reciprocating element 18 when the suction valve assembly 56 approaches an open configuration (i.e., is opening) and toward the suction valve seat when the suction valve assembly 56 approaches a closed configuration (i.e., is closing).

Pump 10 comprises a discharge valve assembly 72 for controlling the output of fluid through discharge chamber 53 and discharge outlet 54. Analogous to the suction valve assembly 56, the discharge valve assembly 72 may alternately open or close to permit or prevent fluid flow. Those versed in the art will understand that the discharge valve assembly 72 may be disposed within the pump chamber at any suitable location therein. For instance, the discharge valve assembly 72 may be disposed within the bore 25 proximal the top S3 of the pump fluid end 22, in cross-bore pump fluid end 22 designs such as FIG. 2A and tee-bore pump fluid end 22 designs such as FIG. 2B, such that a discharge valve body (e.g., a poppet assembly) of the discharge valve assembly 72 moves toward the discharge chamber 53 when the discharge valve assembly 72 approaches an open configuration and away from the discharge chamber 53 when the discharge valve assembly 72 approaches a closed configuration. The discharge valve assembly 72 may be disposed proximal the front S1 of bore 24 of the pump fluid end 22 (e.g., at least partially within discharge chamber 53 and/or pump chamber 28) in concentric bore pump fluid end 22 designs such as FIG. 3, such that a discharge valve body (e.g., poppet assembly) of the discharge valve assembly 72 moves toward the discharge chamber 53 when the discharge valve assembly 72 approaches an open configuration and away from the discharge chamber 53 when the discharge valve assembly 72 approaches a closed configuration. In addition, the discharge valve assembly 72 may be co-axially aligned with the suction valve assembly 56 (e.g., along central axis 17 in concentric bore pump fluid end 22 configurations such as FIG. 3 or along central axis 27 of bore 25 perpendicular to central axis 17 in cross-bore pump fluid end 22 configurations such as FIG. 2A and FIG. 2B). In concentric bore pump fluid end 22 configurations such as FIG. 3, the suction valve assembly 56 and the discharge valve assembly 72 may be coaxially aligned with the reciprocating element 18 (e.g., along central axis 17).

Further, the suction valve assembly 56 and the discharge valve assembly 72 can comprise any suitable mechanism for opening and closing valves. For example, the suction valve assembly 56 and the discharge valve assembly 72 can comprise a suction valve spring and a discharge valve spring, respectively. Additionally, any suitable structure (e.g., valve assembly comprising sealing rings, stems, valve guides, poppets, etc.) and/or components may be employed for retaining the components of the suction valve assembly 56 and the components of the discharge valve assembly 72 within the pump fluid end 22. According to embodiments of this disclosure, the discharge valve assembly 72 and/or the suction valve assembly 56 can comprise a valve poppet assembly, as described, for example, in U.S. patent application Ser. No. 16/436,356 filed Jun. 10, 2019 and entitled "Multi-Material Frac Valve Poppet", the disclosure of which is hereby incorporated herein in its entirety for purposes not contrary to this disclosure. As detailed further hereinbelow with reference to FIGS. 5A-5B and FIG. 6, suction valve assembly 56 and discharge valve assembly 72 can each comprise a valve seat and a valve body. That is, the suction valve assembly can comprise a suction valve seat and a suction valve body, and the discharge valve assembly 72 can comprise a discharge valve seat and a discharge valve body. The suction valve body and the discharge valve body can be any known valve bodies, for example, movable valve poppets, and can be wing guided and/or stem guided, or a combination thereof.

The fluid inlet 38 may be arranged within any suitable portion of the pump fluid end 22 and configured to supply fluid to the pump in any direction and/or angle. Moreover, the pump fluid end 22 may comprise and/or be coupled to any suitable conduit (e.g., pipe, tubing, or the like) through which a fluid source may supply fluid to the fluid inlet 38. The pump 10 may comprise and/or be coupled to any suitable fluid source for supplying fluid to the pump via the fluid inlet 38. In embodiments, the pump 10 may also comprise and/or be coupled to a pressure source such as a boost pump (e.g., a suction boost pump) fluidly connected to the pump 10 (e.g., via inlet 38) and operable to increase or "boost" the pressure of fluid introduced to pump 10 via fluid inlet 38. A boost pump may comprise any suitable type including, but not limited to, a centrifugal pump, a gear pump, a screw pump, a roller pump, a scroll pump, a piston/plunger pump, or any combination thereof. For instance, the pump 10 may comprise and/or be coupled to a boost pump known to operate efficiently in high-volume operations and/or may allow the pumping rate therefrom to be adjusted. Skilled artisans will readily appreciate that the amount of added pressure may depend and/or vary based on factors such as operating conditions, application requirements, etc. In one aspect, the boost pump may have an outlet pressure greater than or equal to about 70 psi, about 80 psi, or about 110 psi, providing fluid to the suction side of pump 10 at about said pressures. Additionally or alternatively, the boost pump may have a flow rate of greater than or equal to about 80 BPM, about 70 BPM, and/or about 50 BPM.

As noted hereinabove, the pump 10 may be implemented as a multi-cylinder pump comprising multiple cylindrical reciprocating element bores 24 and corresponding components. In embodiments, the pump 10 is a Triplex pump in which the pump fluid end 22 comprises three reciprocating assemblies, each reciprocating assembly comprising a suction valve assembly 56, a discharge valve assembly 72, a pump chamber 28, a fluid inlet 38, a discharge outlet 54, and a reciprocating element bore 24 within which a corresponding reciprocating element 18 reciprocates during operation of the pump 10 via connection therewith to a (e.g., common) pump power end 12. In embodiments, the pump 10 is a Quintuplex pump in which the pump fluid end 22 comprises five reciprocating assemblies. In a non-limiting example, the pump 10 may be a Q-10™ Quintuplex Pump or an HT-400™ Triplex Pump, produced by Halliburton Energy Services, Inc.

In embodiments, the pump fluid end 22 may comprise an external manifold (e.g., a suction header) for feeding fluid to the multiple reciprocating assemblies via any suitable inlet(s). Additionally or alternatively, the pump fluid end 22 may comprise separate conduits such as hoses fluidly connected to separate inlets for inputting fluid to each reciprocating assembly. Of course, numerous other variations may be similarly employed, and therefore, fall within the scope of the present disclosure.

Those skilled in the art will understand that the reciprocating elements of each of the reciprocating assemblies may be operatively connected to the pump power end 12 of the pump 10 according to any suitable manner. For instance, separate connectors (e.g., cranks arms/connecting rods 20, one or more additional components or mechanical linkages 4, pushrods 30, etc.) associated with the pump power end 12 may be coupled to each reciprocating element body or tail end 62. The pump 10 may employ a common crankshaft (e.g., crankshaft 16) or separate crankshafts to drive the multiple reciprocating elements.

As previously discussed, the multiple reciprocating elements may receive a supply of fluid from any suitable fluid source, which may be configured to provide a constant fluid supply. Additionally or alternatively, the pressure of supplied fluid may be increased by adding pressure (e.g., boost pressure) as described previously. In embodiments, the fluid inlet(s) 38 receive a supply of pressurized fluid comprising a pressure ranging from about 30 psi to about 300 psi.

Additionally or alternatively, the one or more discharge outlet(s) 54 may be fluidly connected to a common collection point such as a sump or distribution manifold, which may be configured to collect fluids flowing out of the fluid outlet(s) 54, or another cylinder bank and/or one or more additional pumps.

During pumping, the multiple reciprocating elements 18 will perform forward and returns strokes similarly, as described hereinabove. In embodiments, the multiple reciprocating elements 18 can be angularly offset to ensure that no two reciprocating elements are located at the same position along their respective stroke paths (i.e., the plungers are "out of phase"). For example, the reciprocating elements may be angularly distributed to have a certain offset (e.g., 120 degrees of separation in a Triplex pump) to minimize undesirable effects that may result from multiple reciprocating elements of a single pump simultaneously producing pressure pulses. The position of a reciprocating element is generally based on the number of degrees a pump crankshaft (e.g., crankshaft 16) has rotated from a bottom dead center (BDC) position. The BDC position corresponds to the position of a fully retracted reciprocating element at zero velocity, e.g., just prior to a reciprocating element moving (i.e., in a direction indicated by arrow 117 in FIGS. 2A-2B and FIG. 3) forward in its cylinder. A top dead center position corresponds to the position of a fully extended reciprocating element at zero velocity, e.g., just prior to a reciprocating element moving backward (i.e., in a direction indicated by arrow 116 in FIGS. 2A-2B and FIG. 3) in its cylinder.

As described above, each reciprocating element 18 is operable to draw in fluid during a suction (backward or return) stroke and discharge fluid during a discharge (forward) stroke. Skilled artisans will understand that the multiple reciprocating elements 18 may be angularly offset or phase-shifted to improve fluid intake for each reciprocating element 18. For instance, a phase degree offset (at 360 degrees divided by the number of reciprocating elements) may be employed to ensure the multiple reciprocating elements 18 receive fluid and/or a certain quantity of fluid at all times of operation. In one implementation, the three reciprocating elements 18 of a Triplex pump may be phase-shifted by a 120-degree offset. Accordingly, when one reciprocating element 18 is at its maximum forward stroke position, a second reciprocating element 18 will be 60 degrees through its discharge stroke from BDC, and a third reciprocating element will be 120 degrees through its suction stroke from top dead center (TDC).

According to this disclosure, pump fluid end 22 comprises at least one valve module comprising a valve assembly. The valve module comprises the entire valve assembly, such that, when the valve assembly or a component thereof needs repairing and/or replacement, the entire valve module can be removed from the pump and a new or previously repaired valve module inserted in the pump fluid end 22. In embodiments, the at least one valve module is a suction valve module comprising a suction valve assembly. In embodiments, the at least one valve module is a discharge valve module comprising a discharge valve assembly. The valve module of this disclosure comprises a cylindrical canister containing a valve assembly. The valve assembly comprises a valve body and a valve seat, configured such that the valve module provides a fluid flow path from an inlet to an outlet of the valve module along a central axis of the valve module and between the valve body and the valve seat when the valve assembly is in an open configuration, and does not provide the fluid flow path when the valve assembly is in a closed configuration. The valve body and the valve seat are coaxially aligned along the central axis. The valve body contacts the valve seat in the closed configuration and does not contact the valve seat in the open configuration.

As detailed further hereinbelow with reference to FIG. 5A and FIG. 5B, in embodiments, the cylindrical canister further comprises one or more tool engagement features whereby the valve module can be pushed and/or pulled by engagement of a tool with the tool engagement features. The one or more tool engagement features can be located on a top side or a bottom side of the valve module, in embodiments.

As detailed further hereinbelow with reference to FIG. 5A and FIG. 5B, the valve module of this disclosure can further comprise a sealing component. The sealing component can be configured to fix one or more of the components of the valve assembly within the valve module, and can be coupled with the cylindrical canister. For example, in embodiments, a portion of an outer circumference of the sealing component can be coupled (e.g., threadably coupled) with a portion of the inner circumference of the cylindrical canister.

As noted hereinabove, in embodiments the valve assembly is a suction valve assembly and the valve module is a suction valve module. FIG. 5A is a schematic of an exemplary suction valve module 70A, according to embodiments of this disclosure, comprising suction valve assembly 56. In embodiments the valve assembly is a discharge valve assembly and the valve module is a discharge valve module. FIG. 5B is a schematic of an exemplary discharge valve module 70B, according to embodiments of this disclosure, comprising discharge valve assembly 72.

Figure 5A:
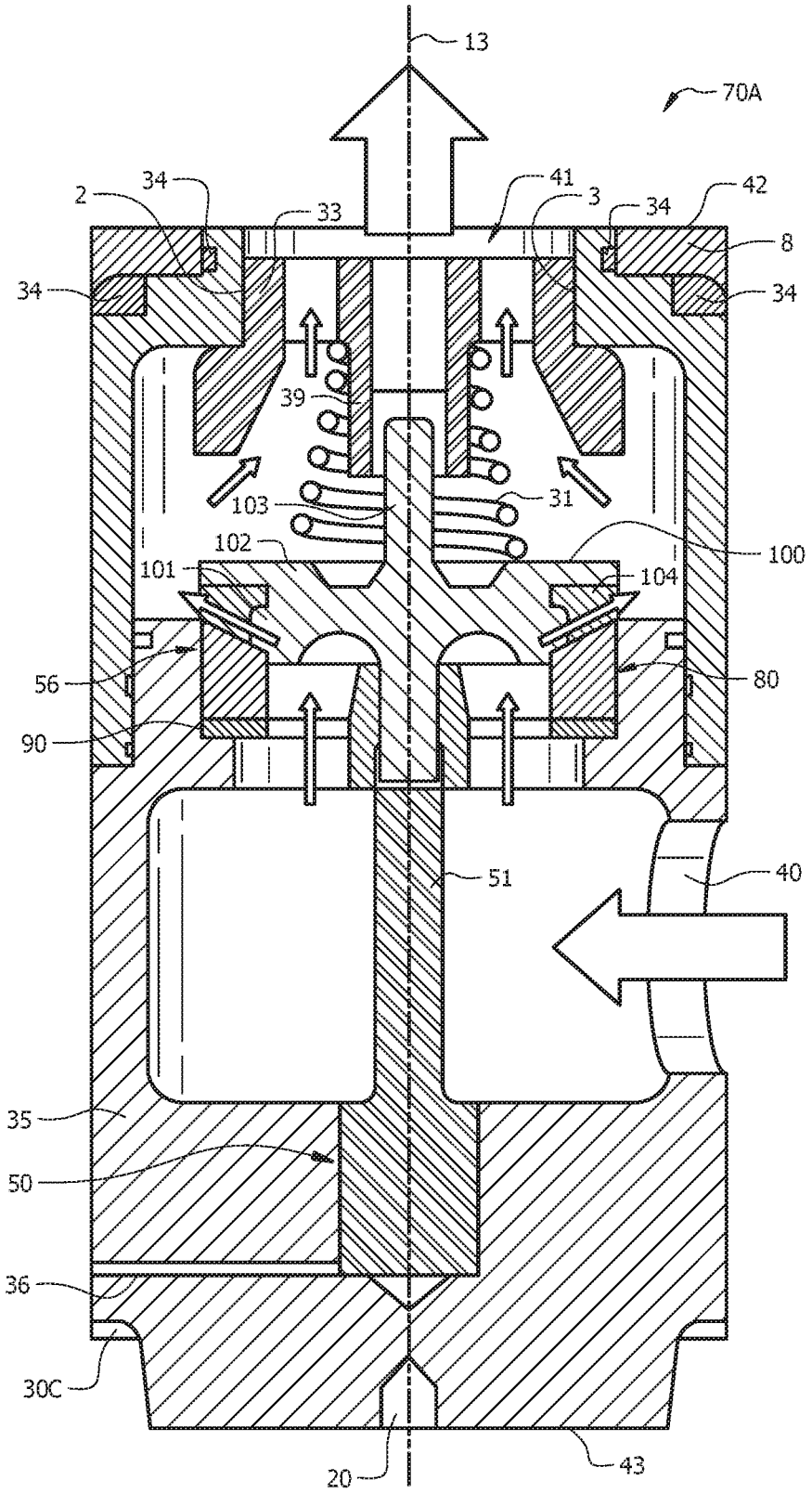
FIG. 5A is a schematic of a valve module, according to embodiments of the present disclosure.

Suction valve module 70A of FIG. 5A comprises: a cylindrical canister 35 containing a suction valve assembly 56. The suction valve assembly 56 comprises a valve body 100, which in this embodiment is a suction valve body, and a valve seat 80, which in this embodiment is a suction valve seat. Discharge valve module 70B of FIG. 5B comprises: a cylindrical canister 35 containing a discharge valve assembly 72. The discharge valve assembly 72 comprises a valve body 100, which in this embodiment is a discharge valve body, and a valve seat 80, which in this embodiment is a discharge valve seat.

Figure 5B:
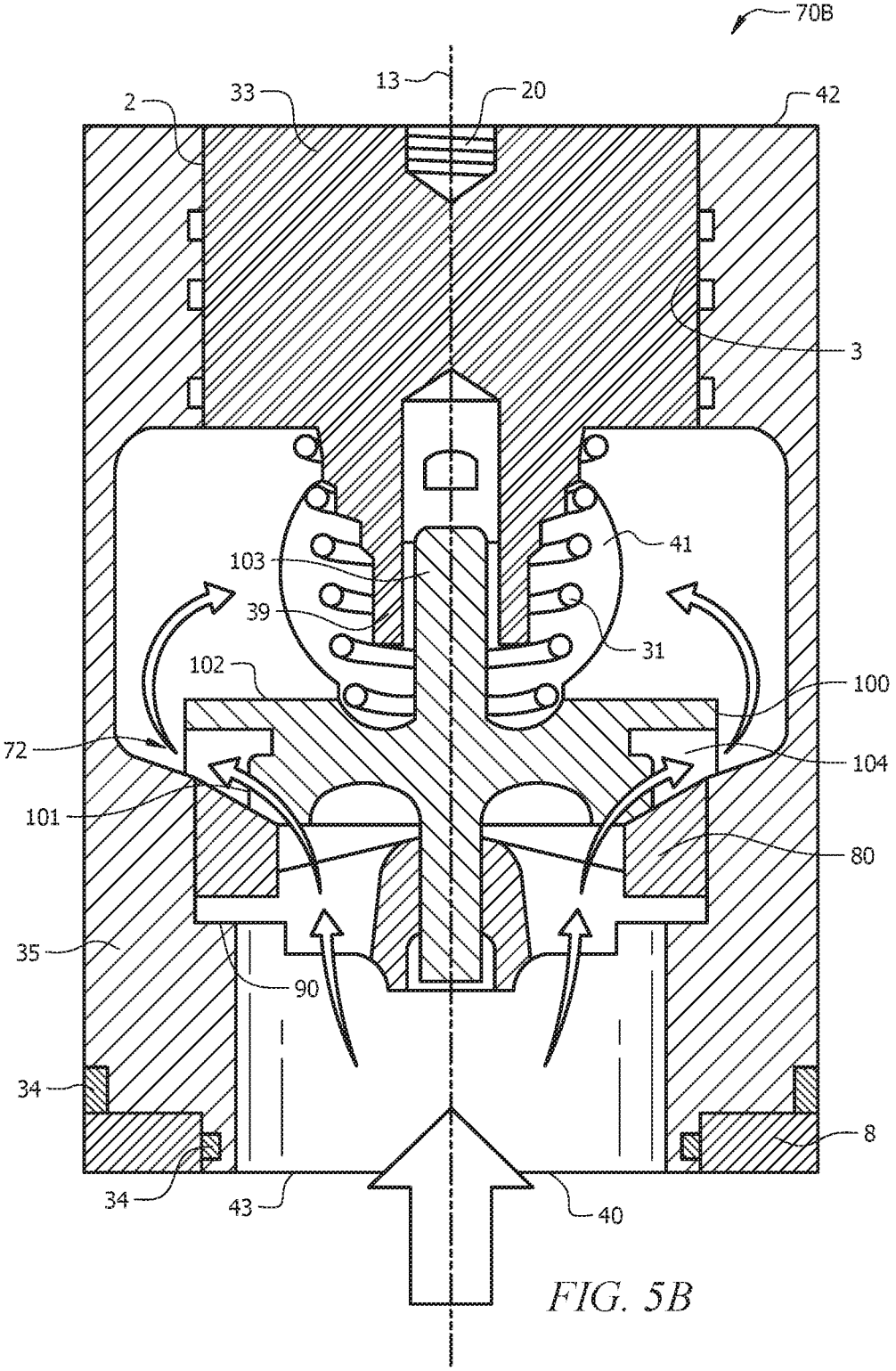
FIG. 5B is a schematic of a valve module, according to embodiments of the present disclosure.

In the exemplary embodiments of FIG. 5A and FIG. 5B, the valve body 80 comprises a valve poppet assembly (also referred to herein as simply a "valve poppet"). However, it is to be understood that any valve assemblies and valve bodies known or to be later invented can be utilized in the valve module.

The suction valve module 70A and the discharge valve module 70B provide a fluid flow path (indicated by arrows)

from an inlet 40 to an outlet 41 of the respective valve module along the central axis 13 thereof and between the valve body 100 and the valve seat 80 when the valve assembly (e.g., suction valve assembly 56 or discharge valve assembly 72, respectively) is in an open configuration, and does not provide the fluid flow path when the valve assembly is in a closed configuration. The valve body 100 and the valve seat 80 are coaxially aligned along the central axis 13. The valve body 100 contacts the valve seat 80 in the closed configuration and does not contact the valve seat 80 in the open configuration of the valve assembly.

As noted hereinabove, any suitable valve body 100 can be utilized as the valve body of suction valve assembly 56 of suction valve module 70A or discharge valve assembly 72 of discharge valve module 70B. In embodiments, such as depicted in FIG. 5A and FIG. 5B, the valve body 100 of the suction valve assembly 56 and/or discharge valve assembly 72 of the pump fluid end 22 comprises a valve poppet assembly. Such a valve poppet assembly is described, for example, in U.S. patent application Ser. No. 16/436,356 filed Jun. 10, 2019 and entitled "Multi-Material Frac Valve Poppet", the disclosure of which is hereby incorporated herein in its entirety for purposes not contrary to this disclosure. In embodiments, valve body 100 is a valve poppet assembly comprising a poppet seat 101, a poppet insert retainer 102, a valve stem 103, and optionally, an insert 104, wherein at least one of the poppet seat 101, the poppet inert retainer 102, and the valve stem 103 is separable from the remaining components of the valve poppet assembly. In such embodiments, in the closed configuration of the suction valve assembly 56 or the discharge valve assembly 72, respectively, poppet seat 101 contacts valve seat 80 and, when present, optional insert 104 contacts valve seat 80. Poppet insert retainer 102 can be coupled with valve stem 103, whereby poppet insert retainer holds poppet seat 101 and/or optional insert 104 in position within the suction valve assembly 56 or the discharge valve assembly 72, respectively. However, as noted hereinabove, numerous valve assemblies can be utilized as the valve assembly (e.g., suction valve assembly 56 or discharge valve assembly 72) of the valve module 70A/70B.

A valve seat housing 90 is located within cylindrical canister 35 of the valve module (e.g., suction valve module 70A or discharge valve module 70B). Valve seat 80 is positioned within the valve module, such that the valve seat 80 is held in the valve seat housing 90. In embodiments, the valve module further comprises a spring 31. Spring 31 can be coaxially positioned about central axis 13. In embodiments, spring 31 can be positioned closer to one side of the valve module 70A/B (e.g., first side 42 or second side 43) than valve body 100. For example, spring 31 of the embodiment of FIG. 5A is closer to first side 42 than valve body 100, and spring 31 of the embodiment of FIG. 5B is closer to first side 42 than valve body 100.

Suction valve module 70A and discharge valve module 70B can further comprise a sealing component 33. Sealing component 33 can be configured to fix one or more of the components of the valve assembly (i.e., suction valve assembly 56 or discharge valve assembly 72) within the valve module, and can be coupled with cylindrical canister 35. For example, in embodiments, a portion of an outer circumference 3 of sealing component 33 can be coupled with a portion of the inner circumference 2 of cylindrical canister 35. In embodiments, the portion of the outer circumference 3 of the sealing component 33 is threadably coupled with the portion of the inner circumference 2 of the cylindrical canister 35. In embodiments, the sealing component 33 comprises a central portion 39 that engages the valve body 100 and/or the spring 31 upon assembly of the valve module. For example, as depicted in the embodiment of FIG. 5A and the embodiment of FIG. 5B, central portion 39 of sealing component 33 engages valve stem 103 of valve body (valve poppet assembly) 100 and spring 31. In the embodiment of FIG. 5A, sealing component 33 of suction valve module 70A is non-sealing at first side 42, since the fluid can freely flow out of the canister 35 (as shown by the arrow at the center of the canister) and upwards when the suction valve assembly is in an open configuration, while in the embodiment of FIG. 5B, sealing component 33 of discharge valve module 70B is sealed at first side 42.

Suction valve module 70A and discharge valve module 70B can further comprise one or more tool engagement features 20, which can be operable for positioning the valve module within a fluid end body 8 of a pump fluid end 22. For example, in the embodiment of FIG. 5A, tool engagement features 20 comprise a threaded hole of suction valve module 70A (e.g., of cylindrical canister 35). In the embodiment of FIG. 5B, tool engagement features 20 comprise a threaded hole of discharge valve module 70B (e.g., of sealing component 33). A tool can be coupled with the one or more tool engagement features 20 and utilized to pull and remove the valve module from the pump fluid end 22, in embodiments.

In embodiments, valve seat 80 of suction valve assembly 56 (which is, in embodiments comprised within a suction valve module 70A) or discharge valve assembly 72 (which is, in embodiments comprised within a discharge valve module 70B) is a valve seat with supplemental retention, as described, for example, in U.S. patent application Ser. No. 16/411,898 filed May 14, 2019, which is entitled "Pump Valve Seat with Supplemental Retention", the disclosure of which is hereby incorporated herein in its entirety for purposes not contrary to this disclosure.

Suction valve module 70A is designed such that, when inserted into a fluid end body 8 of a pump fluid end 22 comprising suction port 38, the inlet 40 of the suction valve module 70A is in fluid communication with the suction port 38. The suction port 38 can be located on a side of suction valve module 70A proximate front S1 of pump fluid end 22 (FIG. 6), in embodiments. Discharge valve module 70B is designed such that, when inserted into a fluid end body 8 of a pump fluid end 22 comprising a discharge port 54, the outlet 41 of the discharge valve module 70B is in fluid communication with the discharge port 54.

With reference to FIG. 5A, a suction valve module 70A of this disclosure can further comprise a valve disabler. The valve disabler is operable to rapidly disable the ability of the pump 10 to pump fluid by forcing the valve body 100 of the suction valve assembly 56 away from the valve seat 80 of the suction valve assembly 56. In embodiments, valve disabler 50 comprises a piston 51 and a hydraulic port 36. Piston 51 of valve disabler 50 can be cylindrical and aligned with the valve body 100 of suction valve assembly 56 along the central axis 13 such that, when actuated, the valve disabler 50 can prevent contact of the valve body 100 with the valve seat 80 of the suction valve assembly 56 by contact of piston 51 with valve body 100. The valve disabler 50 can be hydraulically, electrically, or mechanically actuatable. For example, with reference to FIG. 5A, valve disabler 50 can be actuated by forcing fluid through hydraulic port 36 whereby piston 51 is pushed along central axis 13 toward outlet 41, pushing valve body 100 away from valve seat 80, and thus preventing valve body 100 from returning into contact with valve seat 80 (e.g., the valve body 100 is held in an open configuration by valve disabler 50). In embodiments, valve disabler 50 is not able to lift valve body 100 during the compression/discharge cycle (when pump chamber 28 is under pressure), but, in suction mode, valve disabler 50 is operable to push or lift valve body 100 such that, during the subsequent pressurization cycle, the valve body 100 of suction valve assembly 56 cannot assume the closed configuration and return into contact with valve seat 80 of suction valve assembly 56 (e.g., the valve body 100 is held in the open position by valve disabler 50). In this manner, valve disabler 50 can enable pump 10 to be disabled on demand, for example, in the event of an emergency.

In embodiments, the valve module (e.g., suction valve module 70A and/or discharge valve module 50B) further comprises a valve guide. The valve guide can be coupled with the valve body 100 and configured to align the valve body 100 within the valve module during assembly thereof. In embodiments, suction valve assembly 56 and/or discharge valve assembly 72 comprises a valve assembly having a valve guide, as described, for example, in U.S. patent application Ser. No. 16/411,910 filed May 14, 2019, which is entitled "Valve Assembly for a Fluid End with Limited Access", the disclosure of which is hereby incorporated herein in its entirety for purposes not contrary to this disclosure.

In embodiments, the valve module (e.g., suction valve module 70A and/or discharge valve module 70B) further comprises an insert (e.g., an elastomeric insert, such as poppet insert 104), designed to provide a seal between valve seat 80 and valve body 100 in the closed configuration, such that the fluid flow path is not provided. For example, in embodiments, suction valve assembly 56 and/or discharge valve assembly 72 comprises an insert. The insert is coupled with the valve body 100 and, in the closed configuration the insert contacts the valve seat 80 and, in the open configuration the insert does not contact the valve seat 80. In the embodiments of FIG. 5A and FIG. 5B, suction valve assembly 56 and discharge valve assembly 72 comprise insert 104.

Also disclosed herein is a pump fluid end 22 comprising a suction valve module 70A and/or a discharge valve module 70B. In embodiments, the pump fluid end 22 of this disclosure comprises a suction valve module 70A. In embodiments, the pump fluid end 22 of this disclosure comprises a discharge valve module 70B. In embodiments, the pump fluid end 22 of this disclosure comprises a suction valve module 70A and a discharge valve module 70B. In multiplex pumps 10 comprising a plurality of reciprocating assemblies, each reciprocating assembly can be associated with a suction valve module 70A and/or a discharge valve module 70B.

As described hereinabove, the pump fluid end 22 comprises a fluid end body 8, a reciprocating element 18 at least partially disposed within a reciprocating element bore 24 of the fluid end body 8, a discharge valve assembly 72 comprising a valve seat 80 (e.g., a discharge valve seat) and a valve body 100 (e.g., a discharge valve body), and a suction valve assembly 56 comprising a valve seat 80 (e.g., a suction valve seat) and a valve body 100 (e.g., a suction valve body). According to this disclosure, the suction valve assembly 56, the discharge valve assembly 72, or both the suction valve assembly 56 and the discharge valve assembly 72 is a valve assembly of a valve module 70A/B of this disclosure. That is, the pump fluid end 22 of this disclosure comprises a suction valve module 70A, a discharge valve module 70B, or both a suction valve module 70A and a discharge valve module 70B inserted within the fluid end body 8. In embodiments, a pump fluid end 22 of this disclosure comprises a suction valve module 70A, wherein the suction valve module 70A comprises a cylindrical canister 35 containing the suction valve assembly 56, wherein the suction valve module 70A provides a fluid flow path from an inlet 40 to an outlet 41 of the suction valve module 70A along a central axis 13 of the cylindrical canister 35 and between the valve body 100 and the valve seat 80 of the suction valve assembly 56 when the suction valve assembly 56 is in an open configuration, and does not provide the fluid flow path when the suction valve assembly 56 is in a closed configuration. In embodiments, a pump fluid end 22 of this disclosure comprises a discharge valve module 70B, wherein the discharge valve module 70B comprises a cylindrical canister 35 containing the discharge valve assembly 72, wherein the discharge valve module 70B provides a fluid flow path from an inlet 40 to an outlet 41 of the discharge valve module 70B along the central axis 13 of the cylindrical canister 35 and between the valve body 100 and the valve seat 80 of the discharge valve assembly 72 when the discharge valve assembly 72 is in an open configuration, and does not provide the fluid flow path when the discharge valve assembly 72 is in a closed configuration. In embodiments, a pump fluid end 22 of this disclosure comprises both a suction valve module 70A and a discharge valve module 70B. As noted hereinabove, the reciprocating element bore 24 has a reciprocating element bore central axis 17.

In embodiments, the pump fluid end 22 is a multi-bore pump fluid end, such as the cross-bore pump fluid end 22 of FIG. 2A and comprises a suction valve module 70A and/or a discharge valve module 70B within +−shaped cross-bore 25. In such embodiments comprising the suction valve module 70A, the central axis 13 of the suction valve module 70A overlaps the central axis 27 of cross-bore 25 when the suction valve module 70A is positioned within the pump fluid end 22. In such embodiments comprising the discharge valve module 70B, the central axis 13 of the discharge valve module 70B overlaps the central axis 27 of cross-bore 25 when the discharge valve module 70B is positioned within the pump fluid end 22. In such cross-bore pump fluid end 22 embodiments comprising both the suction valve module 70A and the discharge valve module 70B, the central axis 13 of the suction valve module 70A overlaps the central axis 27 of cross-bore 25 when the suction valve module 70A is positioned within the pump fluid end 22, and the central axis 13 of the discharge valve module 70B overlaps the central axis 27 of cross-bore 25 when the discharge valve module 70B is positioned within the pump fluid end 22.

Figure 6:
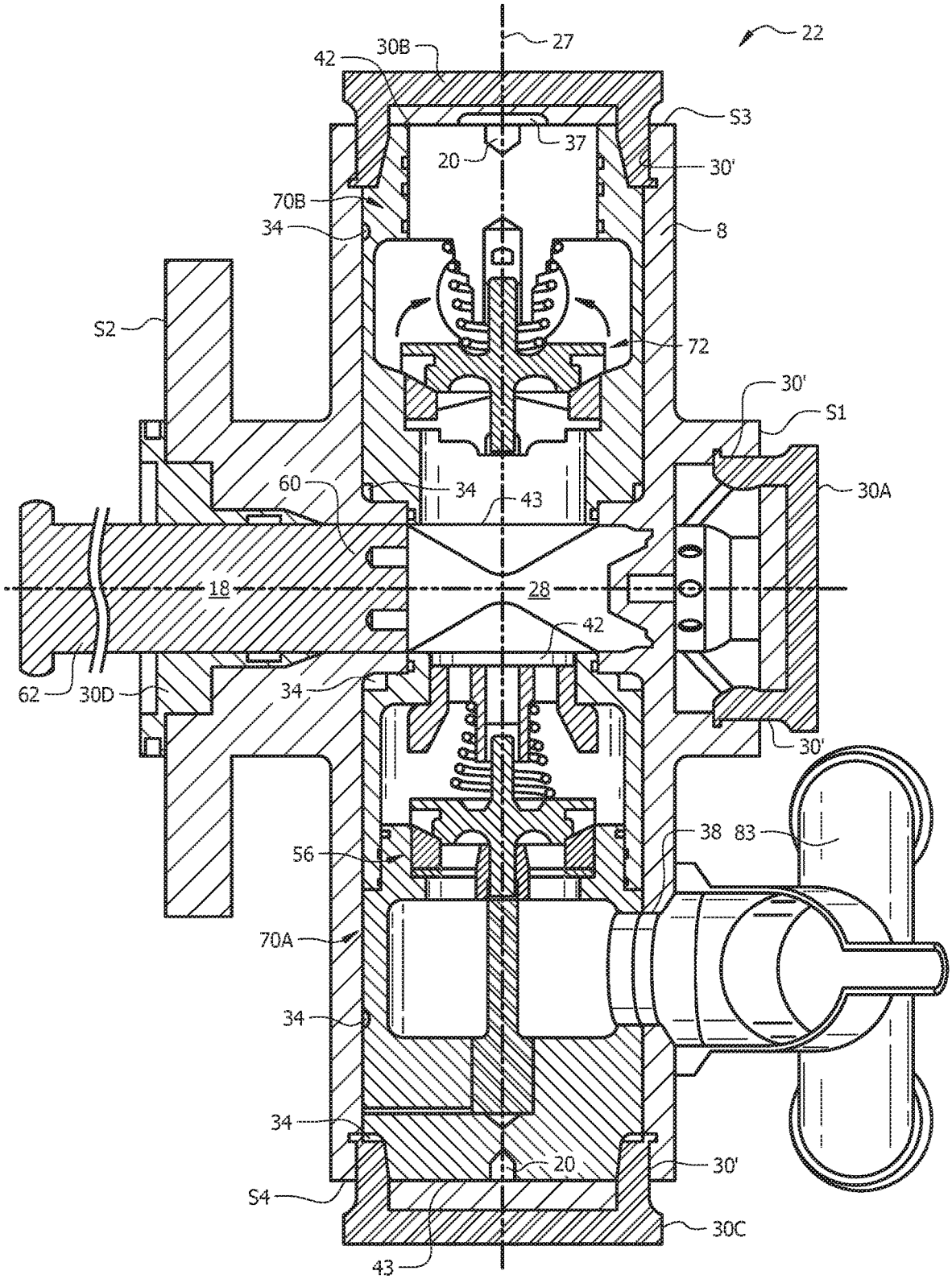
FIG. 6 is a schematic of a pump fluid end comprising a suction valve module and a discharge valve module, according to embodiments of this disclosure.
Figure 7:
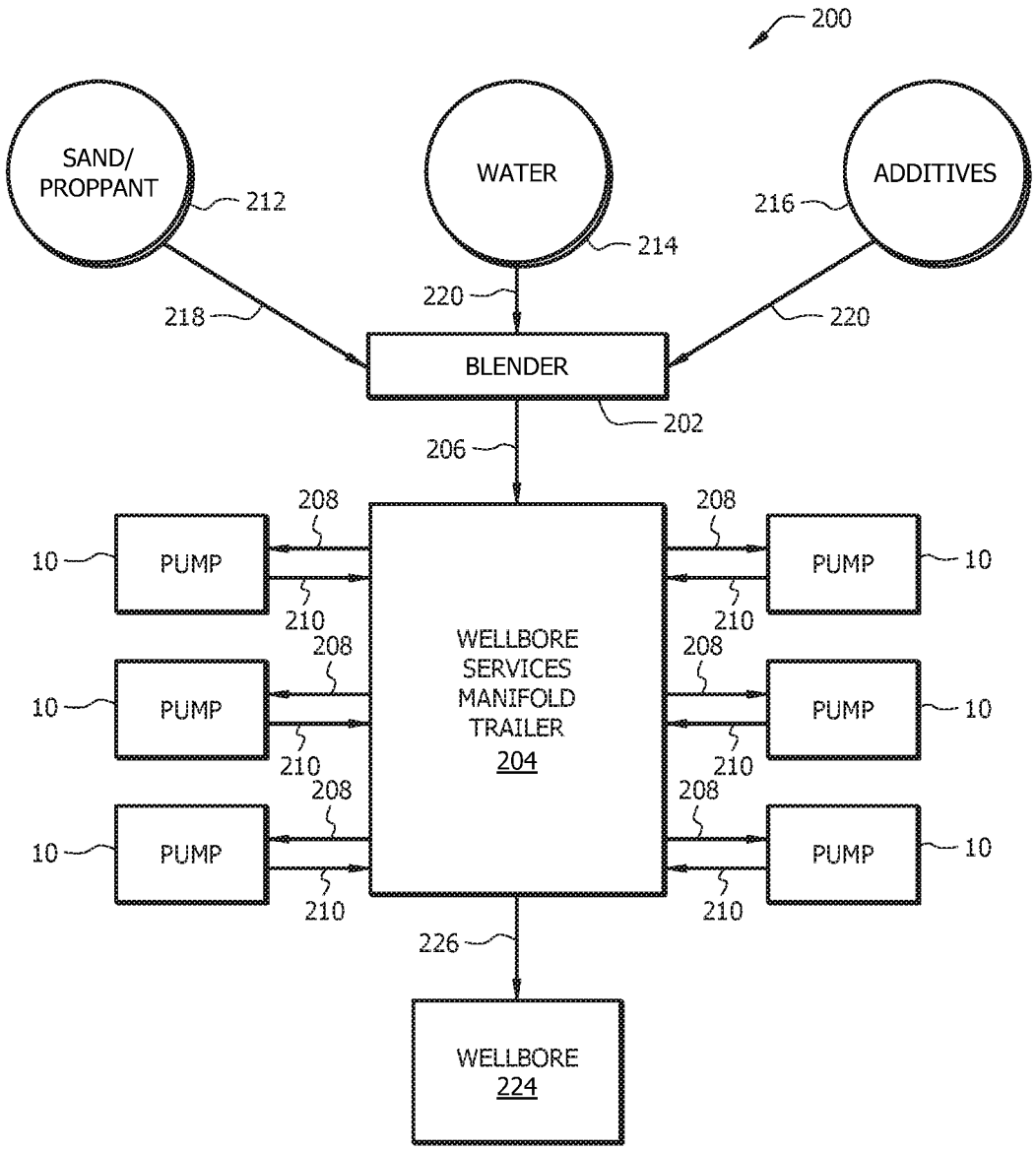
FIG. 7 is a schematic representation of an embodiment of a wellbore servicing system, according to embodiments of this disclosure.

FIG. 6 is a schematic of a pump fluid end 22 comprising a suction valve module 70A and a discharge valve module 70B, according to embodiments of this disclosure. In the embodiment of FIG. 6, suction valve module 70A is positioned within pump fluid end 22 such that first side 42 of is proximate pump chamber 28 and second side 43 of suction valve module 70A is proximate bottom S4 of the pump fluid end 22. In the embodiment of FIG. 6, discharge valve module 70B is positioned within pump fluid end 22 such that first side 42 is proximate top S3 of the pump fluid end 22 and second side 43 of discharge valve module 70B is proximate pump chamber 28. First side 42 is opposite second side 43 thereof along central axis 13 of the valve module. As depicted in FIG. 6, in embodiments, the suction port 38 can be located on a side of suction valve module 70A proximate front S1 of pump fluid end 22 and fluidly connected with suction manifold 83. Valve disabler 50 can be located below (i.e., more toward bottom S4 of pump fluid end 22) suction valve assembly 56, in embodiments.

As described hereinabove, pump fluid end 22 can comprise a front access port 30A, a top access port 30B, and/or a bottom access port 30C. The valve module(s) (e.g., suction valve module 70A and/or discharge valve module 70B) can be positioned within pump fluid end 22 such that one side thereof is proximate one of the pump fluid end access ports, and can be inserted into and removed from pump fluid end 22 thereby. For example, in the embodiment of FIG. 6, second side 43 of suction valve module 70A is proximate bottom access port 30C, whereby a suction valve module 70A can be inserted into and removed from pump fluid end 22 via the bottom access port 30C, while first side 42 of discharge valve module 70B is proximate top access port 30B, whereby a discharge valve module 70B can be inserted into and removed from pump fluid end 22 via the top access port 30B. In embodiments, the access port proximate the one side of the valve module can be associated with a hydraulic preload mechanism. Such a preload mechanism can be operable place an offsetting hydraulic load across the access port to the top of piston 37, and can be utilized, in embodiments during insertion of a valve module into pump fluid end 22. Each access port (e.g., front access port 30A, top access port 30B, and/or bottom access port 30C) can be threadably coupled with fluid end body 8 of pump fluid end 22. For example, at least a portion of an outer circumference 30' of front access port 30A, top access port 30B, and/or bottom access port 30C can be threaded for coupling with fluid end body 8 of pump fluid end 22. The preload mechanism can comprise a piston 37 operable for pumping a hydraulic fluid about the threaded portion of the outer circumference 30' of the access port to reduce load fluctuation on the threads during pumping of a fluid with pump 10 and hence increase the life of the threads. Using this approach, removal of the preload mechanism can also be simplified by depressurizing the preload mechanism, which can be easily removed.

In embodiments, the pump fluid end 22 is a multi-bore pump fluid end, such as the tee-bore pump fluid end 22 of FIG. 2B and comprises a discharge valve module 70B (FIG. 5B) within tee-shaped cross-bore 25. In such embodiments comprising the discharge valve module 70B, the central axis 13 of the discharge valve module 70B overlaps the central axis 27 of tee-bore 25 when the discharge valve module 70B is positioned within the pump fluid end 22. In some such embodiments, a discharge valve module 70B can be inserted into and removed from the tee-bore pump fluid end 22 via a top access port 30B.

In embodiments, the pump fluid end 22 is a concentric bore pump fluid end, such as the concentric bore pump fluid end 22 of FIG. 3 and comprises a discharge valve module 70B (FIG. 5B) located at least partially within pump chamber 28 and/or reciprocating element bore 24. In such embodiments comprising the discharge valve module 70B, the central axis 13 of the discharge valve module 70B overlaps the central axis 17 of reciprocating element bore 24 when the discharge valve module 70B is positioned within the pump fluid end 22. In some such embodiments, a discharge valve module 70B can be inserted into and removed from the concentric bore pump fluid end 22 via a front access port 30A.

One or more sealing elements, such as o-rings 34 depicted in the embodiments of FIGS. 5A-5B and FIG. 6, can be utilized to hold the valve module tightly within fluid end body 8. The sealing elements can comprise o-rings, quad rings, D-rings, or the like, or a combination thereof.

In embodiments, pump fluid end 22 comprises a packing assembly, such that packing 29, a packing carrier, and a packing screw can be removed from back S2 of pump fluid end 22 when crankshaft 16 is at TDC, as described, for example, in U.S. patent application Ser. No. 16/411,911 filed May 14, 2019, which is entitled "Pump Fluid End with Positional Indifference for Maintenance", the disclosure of which is hereby incorporated herein in its entirety for purposes not contrary to this disclosure.

In embodiments, pump fluid end 22 comprises a suction valve stop for assisting closure of suction valve assembly 56, as described, for example, in U.S. patent application Ser. No. 16/436,312 filed Jun. 10, 2019, and entitled "Pump Fluid End with Suction Valve Closure Assist", the disclosure of which is hereby incorporated herein in its entirety for purposes not contrary to this disclosure.

In embodiments, pump 10 of this disclosure is a concentric bore pump fluid end 22 such as depicted in FIG. 3 or a tee-bore pump fluid end such as depicted in FIG. 2B, wherein reciprocating element 18 is coupled with suction valve assembly 56. In some such embodiments, pump 10 further comprises a flexible manifold, as described, for example, in U.S. patent application Ser. No. 16/411,901 filed May 14, 2019, which is entitled "Flexible Manifold for Reciprocating Pump", the disclosure of which is hereby incorporated herein in its entirety for purposes not contrary to this disclosure. In embodiments, pump 10 comprises a fail safe suction hose, as described, for example, in U.S. patent application Ser. No. 16/522,874, filed Jul. 26, 2019, now U.S. Pat. No. 10,677,380 B1, which is entitled "Fail Safe Suction Hose for Significantly Moving Suction Port", the disclosure of which is hereby incorporated herein in its entirety for purposes not contrary to this disclosure.

In embodiments, suction valve assembly 56 of pump fluid end 22 is not modularized, and comprises an easy access suction valve, as described, for example, in U.S. patent application Ser. No. 16/411,891 filed May 14, 2019, which is entitled "Pump Fluid End with Easy Access Suction Valve", the disclosure of which is hereby incorporated herein in its entirety for purposes not contrary to this disclosure.

In embodiments, reciprocating element 18 comprises tool engagement features on front 60 thereof, whereby reciprocating element 18 can be removed from pump fluid end 22 by engaging a tool with the engagement features, as described, for example, in U.S. patent application Ser. No. 16/411,905 filed May 14, 2019, which is entitled "Pump Plunger with Wrench Features", the disclosure of which is hereby incorporated herein in its entirety for purposes not contrary to this disclosure.

Also disclosed herein is a pump 10 comprising a pump fluid end 22 of this disclosure, and a pump power end 12 (such as depicted in FIG. 4 and/or described hereinabove), wherein the pump power end 12 is operable to reciprocate the reciprocating element 18 within the reciprocating element bore 24 of the pump fluid end 22. The pump 10 of this disclosure thus comprises a pump fluid end 22 further comprising a suction valve module 70A, a discharge valve module 70B, or both a suction valve module 70A and a discharge valve module 70B.

In embodiments, reciprocating element 18 is coupled with a pushrod 32 (or another component of mechanical linkages 4 (FIG. 4)) of pump power end 12 via a reciprocating element adapter, as described, for example, in U.S. patent application Ser. No. 16/411,894 filed May 14, 2019, which is entitled "Easy Change Pump Plunger", the disclosure of which is hereby incorporated herein in its entirety for purposes not contrary to this disclosure.

A pump 10 of this disclosure can comprise a multi-layer surface coating disposed on reciprocating element 18 and/or a sleeve that provides cylindrical wall 26, as described, for example, in U.S. patent application Ser. No. 16/436,389 filed Jun. 10, 2019 and is entitled "Multi-Layer Coating for Plunger and/or Packing Sleeve", the disclosure of which is hereby incorporated herein in its entirety for purposes not contrary to this disclosure.

As noted hereinabove, a pump 10 of this disclosure can be a multiplex pump comprising a plurality of reciprocating assemblies (i.e., reciprocating elements 18, and a corresponding plurality of reciprocating element bores 24, suction valve assemblies 56 (some or all of which may each be within a suction valve module 70A), and discharge valve assemblies 72 (some or all of which may be within a discharge valve module 70B)). The plurality can comprise any number such as, for example, 2, 3, 4, 5, 6, 7, or more. For example, in embodiments, pump 10 is a triplex pump, wherein the plurality comprises three. In alternative embodiments, pump 10 comprises a Quintuplex pump, wherein the plurality comprises five.

Also disclosed herein is a method of servicing a pump 10 of this disclosure. The method comprises: opening an access port of a pump fluid end 22 of the pump 10; removing a valve module (a suction valve module 70A and/or a discharge valve module 70B) from the pump fluid end 22; and inserting another valve module (e.g., another suction valve module 70A and/or another discharge valve module 70B, respectively) into the pump fluid end 22.

In embodiments of the method, the valve module is a suction valve module 70A, wherein the valve assembly is a suction valve assembly 56, the valve body 100 is a suction valve body, and the valve seat 80 is a suction valve seat. In some such embodiments, the pump fluid end 22 is a cross-bore pump fluid end, such as depicted in the embodiment of FIG. 2A, and the access port is a bottom access port 30C located on a second side 43 of the suction valve module 70A opposite the outlet 41 thereof. In such embodiments, the suction valve module needing repair is removed via bottom access port 30C, and a new or repaired suction valve module 70A is inserted via bottom access port 30C.

In embodiments, the valve module is a discharge valve module 70B, wherein the valve assembly is a discharge valve assembly 72, the valve body 100 is a discharge valve body, and the valve seat 80 is a discharge valve seat. In some such embodiments, the pump fluid end 22 is a concentric bore pump fluid end, such as depicted in the embodiment of FIG. 3, and the access port is a front access port 30A located on a first side 42 opposite the inlet 40 of the discharge valve module 70B. In other such embodiments, the pump fluid end 22 is a cross-bore pump fluid end, and the access port is a top access port 30B located on a first side 42 opposite the inlet 40 of the discharge valve module 70B.

As noted hereinabove, in embodiments, the valve module (e.g., the suction valve module 70A and/or the discharge valve module 70B) further comprises one or more tool engagement features 20 whereby the valve module can be pushed and/or pulled by engagement of a tool with the tool engagement features 20. In such embodiments, removing the valve module from the pump fluid end 22 can further comprise engaging the tool with the tool engagement features 20 and pulling the valve module out of the pump fluid end 22. In embodiments, a pulling tool such as mechanical screw type or hydraulic pullers, can be used to pull the valve module out of the pump fluid end.

In embodiments, inserting the another valve module in the pump fluid end 22 further comprises positioning the another valve module at least partially within the pump fluid end 22 and applying a force to the valve module to seat the valve module in the pump fluid end 22. Without the use of the valve module approach disclosed, the valve seats 80 are conventionally pressed into the fluid end 22 using specialized hydraulic or screw type pushing devices that must be attached to the fluid end 22 during the installation process. Using the valve module type approach disclosed herein, such as using the suction valve 70A or discharge valve module 70B, the pressing can be effected at a designated shop or facility, and inserting the valve module can comprise sliding the valve module into the fluid end 22, until prior to engaging of the tight portions. These portions or parts can comprise the sealing portions or components (e.g., sealing component 33) of the valve module. Using the hydraulic preload mechanism, the mechanism can initially be attached to the fluid end, 22 using hand tightening process, and possibly using lightweight tools to deliver a slightly higher torque, until a desired depth is nearly reached. (In embodiments, the total stroke of the mechanism is relatively short, meaning that the slack does not exceed the stroke of the preload mechanism.) Pressurizing the preload mechanism, can be utilized, in embodiments, to push the valve module to its intended location, rendering the valve module ready for use. For example, when the access port is associated with a hydraulic preload mechanism, as described hereinabove, the inserting of the another valve module in the pump fluid end 22 can further comprise utilizing the preload mechanism (e.g., a piston 37 associated therewith) to force the valve module into the fluid end body 8 of the pump fluid end 22. In embodiments, the valve module is a suction valve module 70A and inserting the another valve module in the pump fluid end 22 further comprises aligning inlet 40 and outlet 41 of suction valve module 70A such that inlet 40 is in fluid communication with suction port 38 and suction manifold 83 and outlet 41 of suction valve module 70A is in fluid communication with pump chamber 28. In embodiments, the valve module is a discharge valve module 70B and inserting the another valve module in the pump fluid end 22 further comprises aligning inlet 40 of discharge valve module 70B and outlet 41 of discharge valve module 70B such that inlet 40 of discharge valve module 70B is in fluid communication with pump chamber 28 and outlet 41 of discharge valve module 70B is in fluid communication with discharge outlet 54.

The method can further comprise repairing the valve module removed from the pump fluid end 22 and utilizing it as the another valve module inserted into the pump fluid end 22 (or another pump fluid end 22) during a subsequent servicing of the pump 10 (or a servicing of another pump 10). The repair of the removed valve module can comprise replacing one or more components thereof, and/or can be performed on-site or off-site in a repair shop. In this manner, a time needed for valve assembly (e.g., suction valve assembly 56 and/or discharge valve assembly 72) replacement within the module can be significantly reduced relative to a time needed for replacement of a valve assembly that is not modularized as described herein. In embodiments, during servicing of the pump 10, the pump 10 is offline for the servicing of the pump 10 for a downtime that is at least about 20, 30, 40, 50, 60, 70, or 75% less than a downtime needed for servicing a pump 10 that does not comprise the valve module (e.g., does not comprise a suction valve module 70A and/or a discharge valve module 70B).

Also disclosed herein are a method of servicing a wellbore and a wellbore servicing system 200 comprising a pump of this disclosure. An embodiment of a wellbore servicing system 200 and a method of servicing a wellbore via the wellbore servicing system 200 will now be described with reference to FIG. 6, which is a schematic representation of an embodiment of a wellbore servicing system 200, according to embodiments of this disclosure.

A method of servicing a wellbore 224 according to this disclosure comprises: fluidly coupling a pump 10 of this disclosure to a source of a wellbore servicing fluid and to the wellbore; and communicating wellbore 224 servicing fluid into the wellbore 224 via the pump 10. According to this disclosure, as described hereinabove, the pump 10 comprises a pump fluid end 22 and a pump power end 12. The pump power end 12 is operable to reciprocate reciprocating element 18 within a reciprocating element bore 24 of the pump fluid end 22. The pump fluid end 22 comprises a fluid end body 8, the reciprocating element 18 at least partially disposed within the reciprocating element bore 24, a discharge valve assembly 72 comprising a (discharge) valve seat 80 and a (discharge) valve body 100, a suction valve assembly 56 comprising a (suction) valve seat 80 and a (suction) valve body 100, and at least one valve module inserted within the fluid end body 8, wherein the valve module comprises a suction valve module 70A or a discharge valve module 70B. As depicted in FIGS. 2A-2B, FIG. 3, and FIG. 5, the reciprocating element bore 24 has a reciprocating element bore central axis 17. As detailed hereinabove and summarized here, the suction valve module 70A comprises a cylindrical canister 35 containing the suction valve assembly 56, and the suction valve module 70A provides a fluid flow path from a fluid inlet 40 of the suction valve module 70A to a fluid outlet 41 of the suction valve module 70A along a central axis 13 of the suction valve module 70A and between the valve body 100 and the valve seat 80 of the suction valve assembly 56 when the suction valve assembly 56 is in an open configuration, and does not provide the fluid flow path when the suction valve assembly 56 is in a closed configuration. The discharge valve module 70B comprises a cylindrical canister 35 containing the discharge valve assembly 72, and the discharge valve module 70B provides a fluid flow path from an inlet 40 of the discharge valve module 70B to an outlet 41 of the discharge valve module 70B along a central axis 13 of the discharge valve module 70B and between the valve body 100 and the valve seat 80 of the discharge valve assembly 72 when the discharge valve assembly 72 is in an open configuration, and does not provide the fluid flow path when the discharge valve assembly 72 is in a closed configuration.

In embodiments, the method further comprises discontinuing the communicating of the wellbore servicing fluid into the wellbore 224 via the pump 10, subjecting the pump 10 to maintenance to provide a maintained pump 10, and communicating the or another wellbore servicing fluid into the wellbore 224 via the maintained pump 10. Subjecting the pump 10 to maintenance can comprise servicing the pump 10, as described hereinabove. For example, in embodiments, subjecting the pump 10 to maintenance comprises removing one of the at least one valve modules from the pump fluid end 22 and inserting another valve module into the pump fluid end 22.

It will be appreciated that the wellbore servicing system 200 disclosed herein can be used for any purpose. In embodiments, the wellbore servicing system 200 may be used to service a wellbore 224 that penetrates a subterranean formation by pumping a wellbore servicing fluid into the wellbore and/or subterranean formation. As used herein, a "wellbore servicing fluid" or "servicing fluid" refers to a fluid used to drill, complete, work over, fracture, repair, or in any way prepare a well bore for the recovery of materials residing in a subterranean formation penetrated by the well bore. It is to be understood that "subterranean formation" encompasses both areas below exposed earth and areas below earth covered by water such as ocean or fresh water. Examples of servicing fluids suitable for use as the wellbore servicing fluid, the another wellbore servicing fluid, or both include, but are not limited to, cementitious fluids (e.g., cement slurries), drilling fluids or muds, spacer fluids, fracturing fluids or completion fluids, and gravel pack fluids, remedial fluids, perforating fluids, diverter fluids, sealants, drilling fluids, completion fluids, gelation fluids, polymeric fluids, aqueous fluids, oleaginous fluids, etc.

In embodiments, the wellbore servicing system 200 comprises one or more pumps 10 operable to perform oilfield and/or well servicing operations. Such operations may include, but are not limited to, drilling operations, fracturing operations, perforating operations, fluid loss operations, primary cementing operations, secondary or remedial cementing operations, well abandonment processes, or any combination of operations thereof. Although a wellbore servicing system is illustrated, skilled artisans will readily appreciate that the pump 10 disclosed herein may be employed in any suitable operation.

In embodiments, the wellbore servicing system 200 may be a system such as a fracturing spread for fracturing wells in a hydrocarbon-containing reservoir. In fracturing operations, wellbore servicing fluids, such as particle laden fluids, are pumped at high-pressure into a wellbore. The particle laden fluids may then be introduced into a portion of a subterranean formation at a sufficient pressure and velocity to cut a casing and/or create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing may desirably create high-conductivity fluid communication between the wellbore and the subterranean formation.

The wellbore servicing system 200 comprises a blender 202 that is coupled to a wellbore services manifold trailer 204 via flowline 206. As used herein, the term "wellbore services manifold trailer" includes a truck and/or trailer comprising one or more manifolds for receiving, organizing, and/or distributing wellbore servicing fluids during wellbore servicing operations. In this embodiment, the wellbore services manifold trailer 204 is coupled to six positive displacement pumps (e.g., such as pump 10 that may be mounted to a trailer and transported to the wellsite via a semi-tractor) via outlet flowlines 208 and inlet flowlines 210. In alternative embodiments, however, there may be more or less pumps used in a wellbore servicing operation. Outlet flowlines 208 are outlet lines from the wellbore services manifold trailer 204 that supply fluid to the pumps 10. Inlet flowlines 210 are inlet lines from the pumps 10 that supply fluid to the wellbore services manifold trailer 204.

The blender 202 mixes solid and fluid components to achieve a well-blended wellbore servicing fluid. As depicted, sand or proppant 212, water 214, and additives 216 are fed into the blender 202 via feedlines 218, 220, and 212, respectively. The water 214 may be potable, non-potable, untreated, partially treated, or treated water. In embodiments, the water 214 may be produced water that has been extracted from the wellbore while producing hydrocarbons form the wellbore. The produced water may comprise dissolved and/or entrained organic materials, salts, minerals, paraffins, aromatics, resins, asphaltenes, and/or other natural or synthetic constituents that are displaced from a hydrocarbon formation during the production of the hydrocarbons. In embodiments, the water 214 may be flowback water that has previously been introduced into the wellbore during wellbore servicing operation. The flowback water may comprise some hydrocarbons, gelling agents, friction reducers, surfactants and/or remnants of wellbore servicing fluids previously introduced into the wellbore during wellbore servicing operations.

The water 214 may further comprise local surface water contained in natural and/or manmade water features (such as ditches, ponds, rivers, lakes, oceans, etc.). Still further, the water 214 may comprise water stored in local or remote containers. The water 214 may be water that originated from near the wellbore and/or may be water that has been transported to an area near the wellbore from any distance. In some embodiments, the water 214 may comprise any combination of produced water, flowback water, local surface water, and/or container stored water. In some implementations, water may be substituted by nitrogen or carbon dioxide; some in a foaming condition. In some embodiments, water may be substituted by acids, such as hydrochloric acids or hydrofluoric acids; with acid concentrations that are low (like 4%) to very high (above 30%). Water could be gelled using various gelling agents or even plugging agents. Fuels, such as diesel or produced gas, can also be used as treatment fluid, in embodiments.

In embodiments, the blender 202 may be an Advanced Dry Polymer (ADP) blender and the additives 216 are dry blended and dry fed into the blender 202. In alternative embodiments, however, additives may be pre-blended with water using other suitable blenders, such as, but not limited to, a GEL PRO blender, which is a commercially available preblender trailer from Halliburton Energy Services, Inc., to form a liquid gel concentrate that may be fed into the blender 202. The mixing conditions of the blender 202, including time period, agitation method, pressure, and temperature of the blender 202, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering a wellbore services manifold trailer 204.

In embodiments, the pump(s) 10 (e.g., pump(s) 10 and/or maintained pump(s) 10) pressurize the wellbore servicing fluid to a pressure suitable for delivery into a wellbore 224 or wellhead. For example, the pumps 10 may increase the pressure of the wellbore servicing fluid (e.g., the wellbore servicing fluid and/or the another wellbore servicing fluid) to a pressure of greater than or equal to about 3,000 psi, 5,000 psi, 10,000 psi, 20,000 psi, 30,000 psi, 40,000 psi, or 50,000 psi, or higher.

From the pumps 10, the wellbore servicing fluid may reenter the wellbore services manifold trailer 204 via inlet flowlines 210 and be combined so that the wellbore servicing fluid may have a total fluid flow rate that exits from the wellbore services manifold trailer 204 through flowline 226 to the flow connector wellbore 1128 of between about 1 BPM to about 200 BPM, alternatively from between about 50 BPM to about 150 BPM, alternatively about 100 BPM. In embodiments, each of one or more pumps 10 discharge wellbore servicing fluid at a fluid flow rate of between about 1 BPM to about 200 BPM, alternatively from between about 50 BPM to about 150 BPM, alternatively about 100 BPM. In embodiments, each of one or more pumps 10 discharge wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

Persons of ordinary skill in the art with the aid of this disclosure will appreciate that the flowlines described herein are piping that are connected together for example via flanges, collars, welds, etc. These flowlines may include various configurations of pipe tees, elbows, and the like. These flowlines connect together the various wellbore servicing fluid process equipment described herein.

Also disclosed herein are methods for servicing a wellbore (e.g., wellbore 224). Without limitation, servicing the wellbore may include: positioning the wellbore servicing composition in the wellbore 224 (e.g., via one or more pumps 10 as described herein) to isolate the subterranean formation from a portion of the wellbore; to support a conduit in the wellbore; to plug a void or crack in the conduit; to plug a void or crack in a cement sheath disposed in an annulus of the wellbore; to plug a perforation; to plug an opening between the cement sheath and the conduit; to prevent the loss of aqueous or nonaqueous drilling fluids into loss circulation zones such as a void, vugular zone, or fracture; to plug a well for abandonment purposes; to divert treatment fluids; and/or to seal an annulus between the wellbore and an expandable pipe or pipe string. In other embodiments, the wellbore servicing systems and methods may be employed in well completion operations such as primary and secondary cementing operation to isolate the subterranean formation from a different portion of the wellbore.

In embodiments, a wellbore servicing method may comprise transporting a positive displacement pump (e.g., pump 10) to a site for performing a servicing operation. Additionally or alternatively, one or more pumps may be situated on a suitable structural support. Non-limiting examples of a suitable structural support or supports include a trailer, truck, skid, barge or combinations thereof. In embodiments, a motor or other power source for a pump may be situated on a common structural support.

In embodiments, a wellbore servicing method may comprise providing a source for a wellbore servicing fluid. As described above, the wellbore servicing fluid may comprise any suitable fluid or combinations of fluid as may be appropriate based upon the servicing operation being performed. Non-limiting examples of suitable wellbore servicing fluid include a fracturing fluid (e.g., a particle laden fluid, as described herein), a perforating fluid, a cementitious fluid, a sealant, a remedial fluid, a drilling fluid (e.g., mud), a spacer fluid, a gelation fluid, a polymeric fluid, an aqueous fluid, an oleaginous fluid, an emulsion, various other wellbore servicing fluid as will be appreciated by one of skill in the art with the aid of this disclosure, and combinations thereof. The wellbore servicing fluid may be prepared onsite (e.g., via the operation of one or more blenders) or, alternatively, transported to the site of the servicing operation.

In embodiments, a wellbore servicing method may comprise fluidly coupling a pump 10 to the wellbore servicing fluid source. As such, wellbore servicing fluid may be drawn into and emitted from the pump 10. Additionally or alternatively, a portion of a wellbore servicing fluid placed in a wellbore 224 may be recycled, i.e., mixed with the water stream obtained from a water source and treated in fluid treatment system. Furthermore, a wellbore servicing method may comprise conveying the wellbore servicing fluid from its source to the wellbore via the operation of the pump 10 disclosed herein.

In alternative embodiments, the reciprocating apparatus may comprise a compressor. In embodiments, a compressor similar to the pump 10 may comprise at least one each of a cylinder, plunger, connecting rod, crankshaft, and housing, and may be coupled to a motor. In embodiments, such a compressor may be similar in form to a pump and may be configured to compress a compressible fluid (e.g., a gas) and thereby increase the pressure of the compressible fluid. For example, a compressor may be configured to direct the discharge therefrom to a chamber or vessel that collects the compressible fluid from the discharge of the compressor until a predetermined pressure is built up in the chamber. Generally, a pressure sensing device may be arranged and configured to monitor the pressure as it builds up in the chamber and to interact with the compressor when a predetermined pressure is reached. At that point, the compressor may either be shut off, or alternatively the discharge may be directed to another chamber for continued operation.

In embodiments, a reciprocating apparatus comprises an internal combustion engine, hereinafter referred to as an engine. Such engines are also well known, and typically include at least one each of a plunger, cylinder, connecting rod, and crankshaft. The arrangement of these components is substantially the same in an engine and a pump (e.g. pump 10). A reciprocating element 18 such as a plunger may be similarly arranged to move in reciprocating fashion within the cylinder. Skilled artisans will appreciate that operation of an engine may somewhat differ from that of a pump. In a pump, rotational power is generally applied to a crankshaft acting on the plunger via the connecting rod, whereas in an engine, rotational power generally results from a force (e.g., an internal combustion) exerted on or against the plunger, which acts against the crankshaft via the connecting rod.

For example, in a typical 4-stroke engine, arbitrarily beginning with the exhaust stroke, the plunger is fully extended during the exhaust stroke, (e.g., minimizing the internal volume of the cylinder). The plunger may then be retracted by inertia or other forces of the engine componentry during the intake stroke. As the plunger retracts within the cylinder, the internal volume of cylinder increases, creating a low pressure within the cylinder into which an air/fuel mixture is drawn. When the plunger is fully retracted within the cylinder, the intake stroke is complete, and the cylinder is substantially filled with the air/fuel mixture. As the crankshaft continues to rotate, the plunger may then be extended, during the compression stroke, into the cylinder compressing the air-fuel mixture within the cylinder to a higher pressure.

A spark plug may be provided to ignite the fuel at a predetermined point in the compression stroke. This ignition increases the temperature and pressure within the cylinder substantially and rapidly. In a diesel engine, however, the spark plug may be omitted, as the heat of compression derived from the high compression ratios associated with diesel engines suffices to provide spontaneous combustion of the air-fuel mixture. In either case, the heat and pressure act forcibly against the plunger and cause it to retract back into the cylinder during the power cycle at a substantial force, which may then be exerted on the connecting rod, and thereby on to the crankshaft.

Those of ordinary skill in the art will readily appreciate various benefits that may be realized by the present disclosure. For instance, the herein disclosed pump fluid end 22 design comprising a valve module (e.g., a suction valve module 70A and/or a discharge valve module 70B) according to this disclosure enables rapid replacement of a valve assembly (e.g., a suction valve assembly 56 and/or a discharge valve assembly 72). The use of a modularized valve assembly can reduce a downtime of a pump 10 for replacement of a suction valve assembly 56 and/or a discharge valve assembly 72. By utilizing a valve module that contains all the parts of the suction valve assembly 56 or the discharge valve assembly 72 (e.g., valve/body 100, insert/seal 104, valve seat 80, valve spring 31, and/or flow paths (indicated by arrows in FIG. 5A and FIG. 5B)), the pump 10 can be serviced simply, for example, by pulling the valve module out of the pump fluid end 22 of the pump 10, and replacing it with a replacement (e.g., a repaired or new) valve module. In embodiments, the downtime can be reduced by at least 20, 30, 40, 50, 60, 70, or 75% relative to the downtime needed to replace a non-modularized valve assembly. In embodiments, for example, the downtime for replacing a suction valve assembly 56 or a discharge valve assembly 72 is reduced from a few hours to a few minutes by use of the herein disclosure modularized valve assembly (i.e., the valve module). Utilization of the herein-disclosed modularized suction valve assembly (e.g., suction valve module 70A) and discharge valve assembly (e.g., discharge valve module 70B) can thus reduce non-productive time of a pump 10 comprising same.

As operating pumps at high pressure can result in erosion, corrosion, and cracking of components such as components of a valve assembly, high costs can be incurred (e.g., for parts and downtime) for replacing such components, and reducing downtime as described herein can reduce costs. By utilizing valve module(s) as disclosed herein, a valve assembly can be removed from a pump fluid end 22 and quickly replaced with a new or previously repaired valve module(s). The removed valve module can be repaired or refurbished (e.g., sent to a shop for repair), and subsequently utilized as a replacement valve module for the or another pump fluid end 22. Via the utilization of the valve module(s) as per this disclosure, time is not lost separately removing various components (e.g., a valve spring 31, a valve guide, a valve body (e.g., a valve poppet assembly) 100, a valve disabler 50 and/or a valve seat 80 of a valve assembly) from the pump fluid end 22 and inserting a replacement (e.g., a new or repaired) valve disabler, valve seat 80, valve guide, valve body (e.g., a valve poppet assembly) 100, and/or a valve spring into the pump fluid end 22.

Additional Disclosure

The following are non-limiting, specific embodiments in accordance with the present disclosure:

Embodiment A: A valve module comprising: a cylindrical canister containing a valve assembly for a high pressure pump, wherein the valve assembly comprises a valve body and a valve seat, wherein the valve module provides a fluid flow path from an inlet to an outlet of the valve module from one side of the valve seat along a central axis of the valve module to the other side of the valve seat along the central axis and between the valve body and the valve seat when the valve assembly is in an open configuration, and does not provide the fluid flow path when the valve assembly is in a closed configuration.

Embodiment B: The valve module of Embodiment A, wherein the inlet and the outlet of the valve module are centrally aligned along the central axis of the valve module.

Embodiment C: The valve module of Embodiment A, wherein the inlet and the outlet of the valve module are angularly aligned along the central axis of the valve module.

Embodiment D: The valve module of any of Embodiment A to Embodiment C, wherein the valve body and the valve seat are coaxially aligned along the central axis of the valve module.

Embodiment E: The valve module of any of Embodiment A to Embodiment D, wherein the valve body contacts the valve seat in the closed configuration and does not contact the valve seat in the open configuration.

Embodiment F: The valve module of any of Embodiment A to Embodiment E, wherein the cylindrical canister further comprises one or more tool engagement features whereby the valve module can be pushed and/or pulled by engagement of a tool with the tool engagement features.

Embodiment G: The valve module of Embodiment F, wherein the one or more tool engagement features are located on a top side or a bottom side of the valve module.

Embodiment H: The valve module of any of Embodiment A to Embodiment G, wherein the valve assembly is a discharge valve assembly.

Embodiment I: The valve module of any of Embodiment H, wherein the valve module is designed such that, when inserted into a fluid end body of a pump fluid end comprising a discharge port, the outlet of the valve module aligns with the discharge port.

Embodiment J: The valve module of any of Embodiment A to Embodiment G, wherein the valve assembly is a suction valve assembly.

Embodiment K: The valve module of Embodiment J, wherein the valve module is designed such that, when inserted into a fluid end body of a pump fluid end comprising a suction port, the inlet of the valve module aligns with the suction port.

Embodiment L: The valve module of Embodiment J or Embodiment K further comprising a valve disabler, wherein the valve disabler is cylindrical and is aligned with the valve body along the central axis, such that, when actuated, the valve disabler can prevent contact of the valve body with the valve seat.

Embodiment M: The valve module of Embodiment L, wherein the valve disabler is hydraulically, electrically or mechanically actuatable.

Embodiment N: The valve module of any of Embodiment A to Embodiment M, wherein the valve body comprises a poppet.

Embodiment O: The valve module of any of Embodiment A to Embodiment N, wherein the valve assembly further comprises a valve guide, an insert, or a combination thereof, wherein the valve guide is coupled with the valve body and configured to align the valve body within the valve module during assembly thereof, and wherein the insert is coupled with the valve body and, in the closed configuration the insert contacts the valve seat and, in the open configuration the insert does not contact the valve seat.

Embodiment P: A pump fluid end comprising: a fluid end body; a reciprocating element at least partially disposed within a reciprocating element bore of the fluid end body, wherein the reciprocating element bore has a reciprocating element bore central axis; a discharge valve assembly comprising a discharge valve seat and a discharge valve body; a suction valve assembly comprising a suction valve seat and a suction valve body; and a suction valve module, a discharge valve module, or both a suction valve module and a discharge valve module inserted within the fluid end body, wherein the suction valve module comprises a cylindrical canister containing the suction valve assembly, wherein the suction valve module provides a fluid flow path from an inlet to an outlet of the valve module from one side of the valve seat along a central axis of the valve module to the other side of the valve seat along the central axis and between the valve body and the valve seat when the suction valve assembly is in an open configuration, and does not provide the fluid flow path when the suction valve assembly is in a closed configuration, and wherein the discharge valve module comprises a cylindrical canister containing the discharge valve assembly, wherein the discharge valve module provides a fluid flow path from an inlet to an outlet of the valve module from one side of the valve seat along a central axis of the valve module to the other side of the valve seat along the central axis and between the valve body and the valve seat when the discharge valve assembly is in an open configuration, and does not provide the fluid flow path when the discharge valve assembly is in a closed configuration.

Embodiment Q: The pump fluid end of Embodiment P, wherein the pump fluid end is a cross-bore pump fluid end and comprises the suction valve module and the discharge valve module.

Embodiment R: The pump fluid end of Embodiment Q, wherein the cross-bore pump fluid end is a T-bore pump fluid end.

Embodiment S: The pump fluid end of Embodiment P, wherein the pump fluid end is a concentric bore pump fluid end and comprises the discharge valve module.

Embodiment T: A pump comprising: the pump fluid end of any of Embodiment P to Embodiment S; and a pump power end, wherein the pump power end is operable to reciprocate the reciprocating element within the reciprocating element bore of the pump fluid end.

Embodiment U: The pump of Embodiment T, wherein the pump fluid end comprises the suction valve module.

Embodiment V: The pump of Embodiment U, wherein the fluid end body further comprises a suction port, and wherein the inlet of the suction valve module aligns with the suction port of the fluid end body.

Embodiment W: The pump of Embodiment U or Embodiment V, wherein the suction valve module further comprises a valve disabler.

Embodiment X: The pump of Embodiment W, wherein the suction valve disabler is hydraulically or mechanically actuatable.

Embodiment Y: The pump of any of Embodiment T to Embodiment X, wherein the pump fluid end comprises the discharge valve module.

Embodiment Z1: The pump of Embodiment Y, wherein the fluid end body further comprises a discharge port, and wherein the outlet of the discharge valve module aligns with the discharge port of the fluid end body.

Embodiment Z2: A method of servicing a pump, the method comprising: opening an access port of a pump fluid end of the pump; removing a valve module from the pump fluid end; and inserting another valve module into the pump fluid end, wherein the valve module comprises: a cylindrical canister containing a valve assembly, wherein the valve assembly comprises a valve body and a valve seat, wherein the valve module provides a fluid flow path from an inlet to an outlet of the valve module from one side of the valve seat along a central axis of the valve module to the other side of the valve seat along the central axis and between the valve body and the valve seat when the valve assembly is in an open configuration, and does not provide the fluid flow path when the valve assembly is in a closed configuration.

Embodiment Z3: The method of Embodiment Z2, wherein the valve module is a suction valve module, wherein the valve assembly is a suction valve assembly, wherein the valve body is a suction valve body, and wherein the valve seat is a suction valve seat.

Embodiment Z4: The method of Embodiment Z3 wherein the pump fluid end is a cross-bore pump fluid end, and wherein the access port is a bottom access port located on a side of the suction valve module opposite the outlet thereof.

Embodiment Z5: The method of Embodiment Z2, wherein the valve module is a discharge valve module, wherein the valve assembly is a discharge valve assembly, wherein the valve body is a discharge valve body, and wherein the valve seat is a discharge valve seat.

Embodiment Z6: The method of Embodiment Z5, wherein the pump fluid end is a concentric bore pump fluid end, and wherein the access port is a front access port located on a side of the discharge valve module opposite the inlet thereof.

Embodiment Z7: The method of Embodiment Z5, wherein the pump fluid end is a cross-bore pump fluid end, and wherein the access port is a top access port located on a side of the discharge valve module opposite the inlet thereof.

Embodiment Z8 The method of Embodiment Z2, wherein the valve module further comprises one or more tool engagement features whereby the valve module can be pushed and/or pulled by engagement of a tool with the tool engagement features, and wherein removing the valve module from the pump fluid end further comprises engaging the tool with the tool engagement features and pulling the valve module.

Embodiment Z9: The method of any Embodiment Z2 to Embodiment Z8, wherein inserting the another valve module in the pump fluid end further comprises positioning the another valve module at least partially within the pump fluid end and applying a force to the valve module to seat the valve module in the pump fluid end.

Embodiment Z10: The method of Embodiment Z9, wherein applying the force to the valve module to seat the valve module in the pump fluid end comprises hammering, pressing with a piston, or a combination thereof.

Embodiment Z11: The method of Embodiment Z10, wherein the access port is associated with a hydraulic preload mechanism, and wherein the inserting of the another valve module in the pump fluid end further comprises utilizing the preload mechanism.

Embodiment Z12: The method of any of Embodiment Z2 to Embodiment Z11 further comprising repairing the valve module removed from the pump fluid end and utilizing it as the another valve module inserted into the pump fluid end during a subsequent servicing of the pump or a servicing of another pump.

Embodiment Z13: The method of any of Embodiment Z2 to Embodiment Z12, wherein the pump is offline for the servicing of the pump for a downtime that is at least about 20, 30, 40, 50, 60, 70, or 75% less than a downtime needed for servicing a pump that does not comprise the valve module.

Embodiment Z14: A method of servicing a wellbore, the method comprising: fluidly coupling a pump to a source of a wellbore servicing fluid and to the wellbore; and communicating wellbore servicing fluid into the wellbore via the pump, wherein the pump comprises a pump fluid end and a pump power end, wherein the pump power end is operable to reciprocate a reciprocating element within a reciprocating element bore of the pump fluid end, and wherein the pump fluid end comprises: a fluid end body; the reciprocating element at least partially disposed within the reciprocating element bore, wherein the reciprocating element bore has a reciprocating element bore central axis; a discharge valve assembly comprising a discharge valve seat and a discharge valve body; a suction valve assembly comprising a suction valve seat and a suction valve body; and at least one valve module inserted within the fluid end body, wherein the at least one valve module comprises a suction valve module and/or a discharge valve module, wherein the suction valve module comprises a cylindrical canister containing the suction valve assembly, wherein the suction valve module provides from an inlet to an outlet of the suction valve module from one side of the suction valve seat along a central axis of the suction valve module to the other side of the suction valve seat along the central axis and between the suction valve body and the suction valve seat when the suction valve assembly is in an open configuration, and does not provide the fluid flow path when the suction valve assembly is in a closed configuration, and wherein the discharge valve module comprises a cylindrical canister containing the discharge valve assembly, wherein the discharge valve module provides a fluid flow path from an inlet to an outlet of the discharge valve module from one side of the discharge valve seat along a central axis of the discharge valve module to the other side of the discharge valve seat along the central axis and between the discharge valve body and the discharge valve seat when the discharge valve assembly is in an open configuration, and does not provide the fluid flow path when the discharge valve assembly is in a closed configuration.

Embodiment Z15: The method of Embodiment Z14 further comprising: discontinuing the communicating of the wellbore servicing fluid into the wellbore via the pump; subjecting the pump to maintenance to provide a maintained pump; and communicating the or another wellbore servicing fluid into the wellbore via the maintained pump, wherein subjecting the pump to maintenance comprises: removing one of the at least one valve modules from the pump fluid end and inserting another valve module into the pump fluid end.

Embodiment Z16: The method of Embodiment Z14 or Embodiment Z15, wherein the wellbore servicing fluid, the another wellbore servicing fluid, or both the wellbore servicing fluid and the another wellbore servicing fluid comprise a fracturing fluid, a cementitious fluid, a remedial fluid, a perforating fluid, a sealant, a drilling fluid, a spacer fluid, a completion fluid, a gravel pack fluid, a gelation fluid, a polymeric fluid, an aqueous fluid, an oleaginous fluid, or a combination thereof.

Embodiment Z17: The method of any of Embodiment Z14 to Embodiment Z16, wherein the pump or the maintained pump operates during the pumping of the wellbore servicing fluid or the another wellbore servicing fluid at a pressure of greater than or equal to about 3,000 psi, 5,000 psi, 10,000 psi, 20,000 psi, 30,000 psi, 40,000 psi, or 50,000 psi.

Embodiment Z18: The method of any of Embodiment Z14 to Embodiment Z17, wherein the pump or the maintained pump operates during the pumping of the wellbore servicing fluid or the another wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

Embodiment Z19: A valve module comprising: a cylindrical canister containing: a valve assembly comprising a valve body and a valve seat, a valve seat housing, a spring, and a sealing component, wherein the valve body and the valve seat are coaxially aligned along a central axis of the valve module, wherein the valve body does not contact the valve seat in an open configuration and contacts the valve seat in a closed configuration, wherein the valve seat is seated in a valve seat housing of the cylindrical canister, wherein the spring is coupled with the valve body, and wherein the sealing component is coupled with the cylindrical canister and with the valve body and retains the valve body in position within the valve module; wherein the valve module provides a fluid flow path from an inlet to an outlet of the valve module from one side of the valve seat along a central axis of the valve module to the other side of the valve seat along the central axis and between the valve body and the valve seat when the valve assembly is in the open configuration, and does not provide the fluid flow path when the valve assembly is in the closed configuration.

Embodiment Z20: The valve module of Embodiment Z19, wherein the cylindrical canister further contains a valve disabler, wherein the valve disabler comprises a cylindrical piston coaxially aligned along the central axis of the valve module on a side of the valve body opposite the outlet of the valve module, wherein the valve disabler is operable to prevent the valve assembly from assuming the closed configuration.

Embodiment Z21: The valve module of Embodiment Z19 or Embodiment Z20, wherein the inlet is perpendicular to the central axis of the valve module or parallel to the central axis of the valve module.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A valve module comprising:

a cylindrical canister containing entirely therein a valve assembly for a pump fluid end of a high pressure pump, such that the entire valve assembly can be inserted into and removed from the pump fluid end, respectively, via insertion of the valve module into and removal of the valve module from the pump fluid end, wherein the valve assembly comprises a valve body and a valve seat, wherein the valve module provides a fluid flow path from an inlet to an outlet of the valve module from one side of the valve seat along a central axis of the valve module to the other side of the valve seat along the central axis and between the valve body and the valve seat when the valve assembly is in an open configuration, and does not provide the fluid flow path when the valve assembly is in a closed configuration, and wherein the valve seat is held in the valve module by a valve seat housing within the cylindrical canister, such that an entire outer wall of the valve seat contacts the valve seat housing.

2. The valve module of claim 1, wherein the cylindrical canister further comprises one or more tool engagement features whereby the valve module can be pushed and/or pulled by engagement of a tool with the tool engagement features.

3. The valve module of claim 1, wherein the valve assembly is a discharge valve assembly.

4. The valve module of claim 3, wherein the valve module is designed such that, when inserted into a fluid end body of a pump fluid end comprising a discharge port, the outlet of the valve module aligns with the discharge port.

5. The valve module of claim 1, wherein the valve assembly is a suction valve assembly.

6. The valve module of claim 5, wherein the valve module is designed such that, when inserted into a fluid end body of a pump fluid end comprising a suction port, the inlet of the valve module aligns with the suction port.

7. A valve module comprising:

a cylindrical canister containing a valve disabler and a valve assembly for a pump fluid end of a high pressure pump, such that the entire valve assembly can be inserted into and removed from the pump fluid end, respectively, via insertion of the valve module into and removal of the valve module from the pump fluid end, wherein the valve assembly comprises a valve body and a valve seat, wherein the valve module provides a fluid flow path from an inlet to an outlet of the valve module from one side of the valve seat along a central axis of the valve module to the other side of the valve seat along the central axis and between the valve body and the valve seat when the valve assembly is in an open configuration, and does not provide the fluid flow path when the valve assembly is in a closed configuration, wherein the valve assembly is a suction valve assembly, wherein the valve module is designed such that, when inserted into a fluid end body of a pump fluid end comprising a suction port, the inlet of the valve module aligns with the suction port, and wherein the valve disabler is cylindrical and is aligned with the valve body along the central axis, such that, when actuated, the valve disabler can prevent contact of the valve body with the valve seat.

8. The valve module of claim 1, wherein the valve assembly further comprises a valve guide, an insert, or a combination thereof, wherein the valve guide is coupled with the valve body and configured to align the valve body within the valve module during assembly thereof, and wherein the insert is coupled with the valve body and, in the closed configuration the insert contacts the valve seat and, in the open configuration the insert does not contact the valve seat.

9. A pump comprising:

a pump fluid end comprising:

a fluid end body;

a reciprocating element at least partially disposed within a reciprocating element bore of the fluid end body, wherein the reciprocating element bore has a reciprocating element bore central axis;

a discharge valve assembly comprising a discharge valve seat and a discharge valve body;

a suction valve assembly comprising a suction valve seat and a suction valve body; and a suction valve module, a discharge valve module, or both a suction valve module and a discharge valve module inserted within the fluid end body, wherein the suction valve module comprises a cylindrical canister containing entirely therein the suction valve assembly, such that the entire valve assembly can be inserted into and removed from the pump fluid end, respectively, via insertion of the valve module into and removal of the valve module from the pump fluid end, wherein the suction valve module provides a fluid flow path from an inlet to an outlet of the suction valve module from one side of the suction valve seat along a central axis of the suction valve module to the other side of the suction valve seat along the central axis and between the suction valve body and the suction valve seat when the suction valve assembly is in an open configuration, and does not provide the fluid flow path when the suction valve assembly is in a closed configuration, and wherein the suction valve seat is held in the suction valve module by a suction valve seat housing within the cylindrical canister, such that an entire outer wall of the suction valve seat contacts the suction valve seat housing, and wherein the discharge valve module comprises a cylindrical canister containing entirely therein the discharge valve assembly, wherein the discharge valve module provides a fluid flow path from an inlet to an outlet of the discharge valve module from one side of the discharge valve seat along a central axis of the discharge valve module to the other side of the discharge valve seat along the central axis and between the discharge valve body and the discharge valve seat when the discharge valve assembly is in an open configuration, and does not provide the fluid flow path when the discharge valve assembly is in a closed configuration, and wherein the discharge valve seat is held in the discharge valve module by a discharge valve seat housing within the cylindrical canister, such that an entire outer wall of the discharge valve seat contacts the discharge valve seat housing; and a pump power end, wherein the pump power end is operable to reciprocate the reciprocating element within the reciprocating element bore of the pump fluid end.

10. The pump of claim 9, wherein the pump fluid end comprises the suction valve module.

11. The pump of claim 10, wherein the fluid end body further comprises a suction port, and wherein the inlet of the suction valve module aligns with the suction port of the fluid end body.

12. The pump of claim 10, wherein the suction valve module further comprises a valve disabler.

13. The pump of claim 12, wherein the suction valve disabler is hydraulically or mechanically actuatable.

14. The pump of claim 9, wherein the pump fluid end comprises the discharge valve module.

15. The pump of claim 14, wherein the fluid end body further comprises a discharge port, and wherein the outlet of the discharge valve module aligns with the discharge port of the fluid end body.

16. A method of servicing a wellbore, the method comprising:

fluidly coupling a pump to a source of a wellbore servicing fluid and to the wellbore; and communicating wellbore servicing fluid into the wellbore via the pump, wherein the pump comprises a pump fluid end and a pump power end, wherein the pump power end is operable to reciprocate a reciprocating element within a reciprocating element bore of the pump fluid end, and wherein the pump fluid end comprises:

a fluid end body;

the reciprocating element at least partially disposed within the reciprocating element bore, wherein the reciprocating element bore has a reciprocating element bore central axis;

a discharge valve assembly comprising a discharge valve seat and a discharge valve body;

a suction valve assembly comprising a suction valve seat and a suction valve body; and at least one valve module inserted within the fluid end body, wherein the at least one valve module comprises a suction valve module and/or a discharge valve module, wherein the suction valve module comprises a cylindrical canister containing entirely therein the suction valve assembly, such that the entire suction valve assembly can be inserted into and removed from the pump fluid end, respectively, via insertion of the suction valve module into and removal of the suction valve module from the pump fluid end, wherein the suction valve module provides a fluid flow path from an inlet to an outlet of the suction valve module along a central axis of the valve module and between the suction valve body and the suction valve seat when the suction valve assembly is in an open configuration, and does not provide the fluid flow path when the suction valve assembly is in a closed configuration, and wherein the suction valve seat is held in the suction valve module by a suction valve seat housing within the cylindrical canister, such that an entire outer wall of the suction valve seat contacts the suction valve seat housing, and wherein the discharge valve module comprises a cylindrical canister containing entirely therein the discharge valve assembly, such that the entire discharge valve assembly can be inserted into and removed from the pump fluid end, respectively, via insertion of the discharge valve module into and removal of the discharge valve module from the pump fluid end, wherein the discharge valve module provides a fluid flow path from an inlet to an outlet of the discharge valve module along a central axis of the valve module and between the discharge valve body and the discharge valve seat when the discharge valve assembly is in an open configuration, and does not provide the fluid flow path when the discharge valve assembly is in a closed configuration, and wherein the discharge valve seat is held in the discharge valve module by a discharge valve seat housing within the cylindrical canister, such that an entire outer wall of the discharge valve seat contacts the discharge valve seat housing.

17. The method of claim 16 further comprising:

discontinuing the communicating of the wellbore servicing fluid into the wellbore via the pump;

subjecting the pump to maintenance to provide a maintained pump; and communicating the or another wellbore servicing fluid into the wellbore via the maintained pump, wherein subjecting the pump to maintenance comprises: removing one of the at least one valve modules from the pump fluid end and inserting another valve module into the pump fluid end.

18. The method of claim 17, wherein the wellbore servicing fluid, the another wellbore servicing fluid, or both the wellbore servicing fluid and the another wellbore servicing fluid comprise a fracturing fluid, a cementitious fluid, a remedial fluid, a perforating fluid, a sealant, a drilling fluid, a spacer fluid, a completion fluid, a gravel pack fluid, a gelation fluid, a polymeric fluid, an aqueous fluid, an oleaginous fluid, or a combination thereof.

19. The method of claim 17, wherein the pump or the maintained pump operates during the pumping of the wellbore servicing fluid or the another wellbore servicing fluid at a pressure of greater than or equal to about 3,000 psi, 5,000 psi, 10,000 psi, 20,000 psi, 30,000 psi, 40,000 psi, or 50,000 psi.

20. The method of claim 17, wherein the pump or the maintained pump operates during the pumping of the wellbore servicing fluid or the another wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

* * * * *